US011143992B2

(12) United States Patent
Sakamoto

(10) Patent No.: US 11,143,992 B2
(45) Date of Patent: Oct. 12, 2021

(54) IMAGE FORMING APPARATUS INCLUDING A DRIVE DEVICE TRANSMITTING A DRIVING FORCE TO A DRIVE MEMBER TO DETACH A UNIT FROM A HOUSING

(71) Applicant: Ricoh Company, Ltd., Tokyo (JP)

(72) Inventor: Shogo Sakamoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/030,623

(22) Filed: Sep. 24, 2020

(65) Prior Publication Data

US 2021/0103238 A1 Apr. 8, 2021

(30) Foreign Application Priority Data

Oct. 7, 2019 (JP) ..... JP2019-184671

(51) Int. Cl.
*G03G 15/20* (2006.01)
*G03G 21/00* (2006.01)

(52) U.S. Cl.
CPC ..... *G03G 15/2028* (2013.01); *G03G 21/0035* (2013.01)

(58) Field of Classification Search
CPC ..... G03G 15/2025; G03G 21/1647; G03G 21/1685
USPC ..... 399/122, 327
See application file for complete search history.

(56) References Cited

U.S. PATENT DOCUMENTS

| | | | | |
|---|---|---|---|---|
| 9,785,101 | B2 * | 10/2017 | Ujiie et al. | G03G 15/2025 |
| 10,852,671 | B2 * | 12/2020 | Imada et al. | G03G 15/2025 |
| 2013/0078021 | A1 | 3/2013 | Sakamoto et al. | |
| 2015/0110525 | A1 | 4/2015 | Sakamoto et al. | |
| 2015/0369338 | A1 | 12/2015 | Sugita et al. | |
| 2016/0265624 | A1 | 9/2016 | Sugita et al. | |
| 2017/0010576 | A1 | 1/2017 | Takagi et al. | |
| 2018/0039221 | A1 | 2/2018 | Nakamoto et al. | |
| 2018/0347667 | A1 | 12/2018 | Sugita et al. | |
| 2020/0159148 | A1 | 5/2020 | Imada et al. | |
| 2020/0249603 | A1 | 8/2020 | Ishigaya et al. | |

FOREIGN PATENT DOCUMENTS

| | | |
|---|---|---|
| JP | 9-230719 | 9/1997 |
| JP | 2014-126732 | 7/2014 |
| JP | 2020-085933 | 6/2020 |
| JP | 2020-085940 | 6/2020 |
| JP | 2020-126088 | 8/2020 |

* cited by examiner

*Primary Examiner* — William J Royer
(74) *Attorney, Agent, or Firm* — Xsensus LLP

(57) ABSTRACT

An image forming apparatus includes a housing, a unit including a drive member and being positioned to the housing, and a drive device configured to rotate the drive member in a normal direction and a reverse direction. The drive device includes a housing-side gear mounted on the housing, and a unit-side gear mounted on the unit, the unit-side gear being configured to mesh with the housing-side gear. The drive device transmits a driving force to the drive member, the driving force causes a force from the housing-side gear to the unit-side gear, the force includes a component force in a direction to detach the unit from the housing, and the component force is smaller than a static friction force between the unit and the housing.

7 Claims, 17 Drawing Sheets

IMAGE FORMING APPARATUS INCLUDING A DRIVE DEVICE TRANSMITTING A DRIVING FORCE TO A DRIVE MEMBER TO DETACH A UNIT FROM A HOUSING

CROSS-REFERENCE TO RELATED APPLICATION

This patent application is based on and claims priority pursuant to 35 U.S.C. § 119(a) to Japanese Patent Application No. 2019-184671, filed on Oct. 7, 2019, in the Japan Patent Office, the entire disclosure of which is hereby incorporated by reference herein.

BACKGROUND

Technical Field

Embodiments of the present disclosure relate to an image forming apparatus.

Background Art

Various types of image forming apparatuses are known to include a unit positioned to a housing of an image forming apparatus, and a drive device driving a drive member provided in the unit to rotate in normal and reverse rotations.

A known image forming apparatus rotates a positioning roller, which functions as a drive member provided in a fixing device that functions as a unit in the normal and reverse rotations.

However, when the drive member, i.e., the positioning roller, is driven, the drive member is likely to move in a direction in which the unit, i.e., the fixing device, that is positioned to the housing of the known image forming apparatus comes off or detaches from a correct position.

SUMMARY

Embodiments of the present disclosure described herein provide a novel image forming apparatus that includes a housing, a unit including a drive member and being positioned to the housing, and a drive device configured to rotate the drive member in a normal direction and a reverse direction. The drive device includes a housing-side gear mounted on the housing, and a unit-side gear mounted on the unit. The unit-side gear is configured to mesh with the housing-side gear. The drive device transmits a driving force to the drive member, the driving force causes a force from the housing-side gear to the unit-side gear, the force includes a component force in a direction to detach the unit from the housing, and the component force is smaller than a static friction force between the unit and the housing.

BRIEF DESCRIPTION OF THE SEVERAL VIEWS OF THE DRAWINGS

Exemplary embodiments of this disclosure will be described in detail based on the following figures, wherein.

Figure 1:
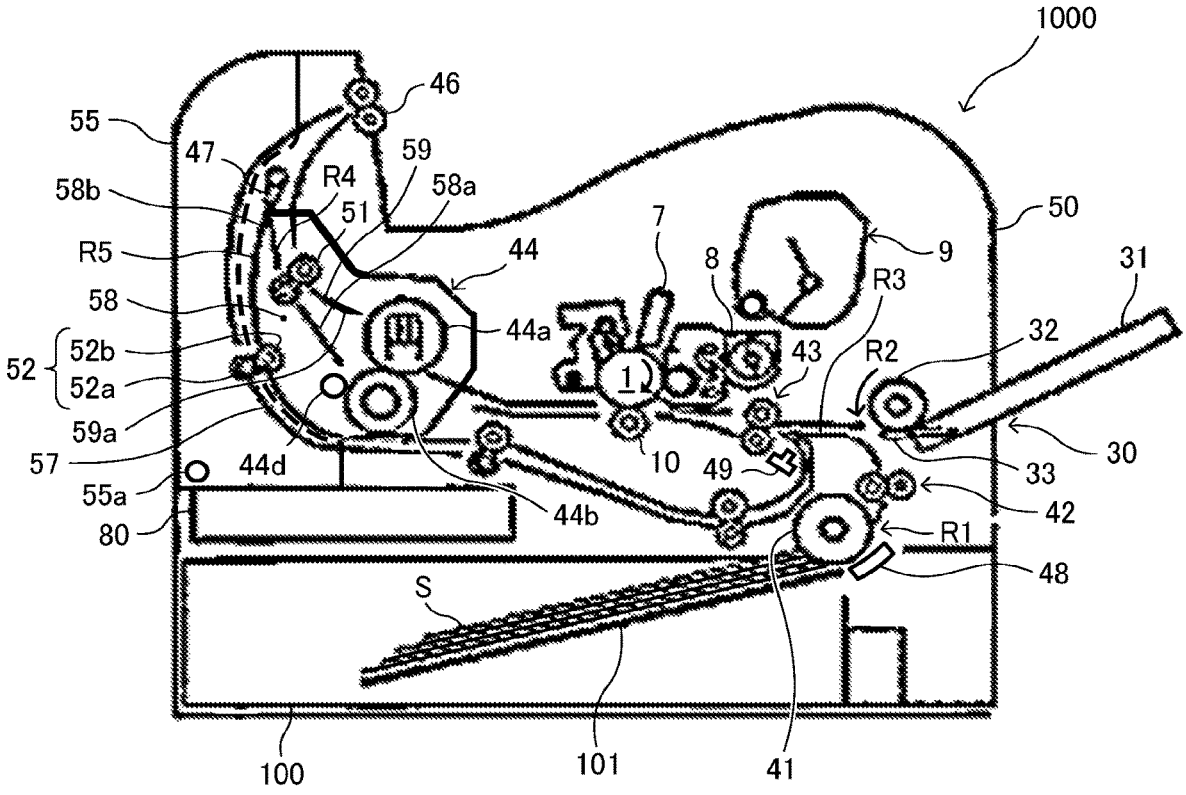
FIG. 1 is a diagram illustrating a schematic configuration of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower." "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, terms such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Now, a description is given of an electrophotographic printer that functions as an electrophotographic image forming apparatus for forming images by electrophotography.

First, a description is given of a basic configuration of an image forming apparatus 1000 according to an embodiment of this disclosure, with reference to FIG. 1. Note that the image forming apparatus 1000 according to an embodiment of this disclosure is not limited to an electrophotographic image forming apparatus. For example, the image forming apparatus according to an embodiment of this disclosure may be an inkjet image forming apparatus employing an inkjet method or an image forming apparatus employing a mimeographic printing method.

FIG. 1 is a schematic diagram illustrating the image forming apparatus 1000 according to an embodiment of this disclosure.

In FIG. 1, the image forming apparatus 1000 according to the present embodiment of this disclosure includes a housing 50, a photoconductor 1, and a sheet tray 100. The photoconductor 1 functions as an image bearer or a latent image bearer. The sheet tray 100 functions as a sheet container that is detachably attachable to the housing 50. The sheet tray 100 contains a plurality of recording sheets S as a sheet bundle that includes a recording sheet S. The sheet tray 100 includes a bottom plate 101 that loads the plurality of recording sheets S as a sheet bundle. The bottom plate 101 is biased upward toward a sheet feed roller 41.

The recording sheet S of the sheet bundle contained in the sheet tray 100 is fed from the sheet tray 100 by rotation of the sheet feed roller 41. When two or more recording sheets S of the plurality of recording sheets S (in other words, the sheet bundle in the sheet tray 100) are fed from the sheet tray 100 at the same time, an uppermost recording sheet S alone is separated from the other recording sheets S in a sheet separation nip region formed between the sheet feed roller 41 and a sheet separation pad 48. After being separated from the other recording sheets S, the upper most recording sheet S is continuously conveyed toward downstream in a sheet conveyance direction in which the recording sheet S is conveyed. Then, the recording sheet S (i.e., the uppermost recording sheet S) reaches a regular sheet conveyance passage R1 that functions as a first sheet conveyance passage. Thereafter, the recording sheet S is sandwiched (held) in a sheet conveyance nip region formed by a pair of relay rollers 42 that functions as a pair of upper conveyance rollers, so that the recording sheet S is conveyed from upstream toward downstream in the sheet conveyance direction in the regular sheet conveyance passage R1. Note that the pair of conveyance rollers may be a pair of conveyance bodies including a belt. In other words, at least one conveyance belt may be employed in the pair of conveyance bodies.

The downstream end of the regular sheet conveyance passage R1 communicates with a common sheet conveyance passage R3. A pair of registration rollers 43 is provided in the common sheet conveyance passage R3. A registration sensor 49 that detects the recording sheet S is also provided in the common sheet conveyance passage R3. The registration sensor 49 is disposed upstream from the pair of registration rollers 43 in the sheet conveyance direction. When the recording sheet S reaches the pair of registration rollers 43, the recording sheet S is stopped temporality in a state in which the leading end of the recording sheet S is in contact with the registration nip region of the pair of registration rollers 43 that is stopped. While the leading end of the recording sheet S contacts the pair of registration rollers 43, skew of the recording sheet S is corrected by the pair of registration rollers 43. Note that the registration sensor 49 is also used for an initial operation and a confirmation operation to check whether there is a remaining recording sheet S when cancelling an abnormal stop of the image forming apparatus 1000.

The pair of registration rollers 43 starts rotating in synchrony with conveyance of the recording sheet S at a timing at which the recording sheet S contacts the surface of the photoconductor 1 to overlay a toner image on the surface of the photoconductor 1 in the sheet transfer nip region. Then, the recording sheet S is conveyed toward the sheet transfer nip region. At this time, the pair of relay rollers 42 starts rotating simultaneously with the start of rotation of the pair of registration rollers 43, so as to start conveyance of the recording sheet S that has been temporarily stopped at the pair of registration rollers 43.

The image forming apparatus 1000 includes a bypass sheet feeder 30 in the housing 50. The bypass sheet feeder 30 includes a bypass sheet tray 31, a bypass sheet feed roller 32, a sheet separation pad 33, a bypass bottom plate, and a bypass bottom plate cam. The recording sheet S manually placed by a user on the bypass sheet tray 31 of the bypass sheet feeder 30 is fed from the bypass sheet tray 31 along with rotation of the bypass sheet feed roller 32 to feed the recording sheet S, to a bypass sheet conveyance passage R2 that functions as a second sheet conveyance passage. The downstream end of the bypass sheet conveyance passage R2 and the downstream end of the regular sheet conveyance passage R1 meet with common sheet conveyance passage R3. The recording sheet S fed out by the bypass sheet feed roller 32 passes the sheet separation nip region formed as the bypass sheet feed roller 32 and the sheet separation pad 33 contact with each other in the bypass sheet conveyance passage R2. Then, the recording sheet S is conveyed to the common sheet conveyance passage R3, and then to the pair of registration rollers 43. Thereafter, similar to the recording sheet S fed from the sheet tray 100, the recording sheet S fed from the bypass sheet tray 31 passes the pair of registration rollers 43 to be conveyed to the transfer nip region.

Figure 2:
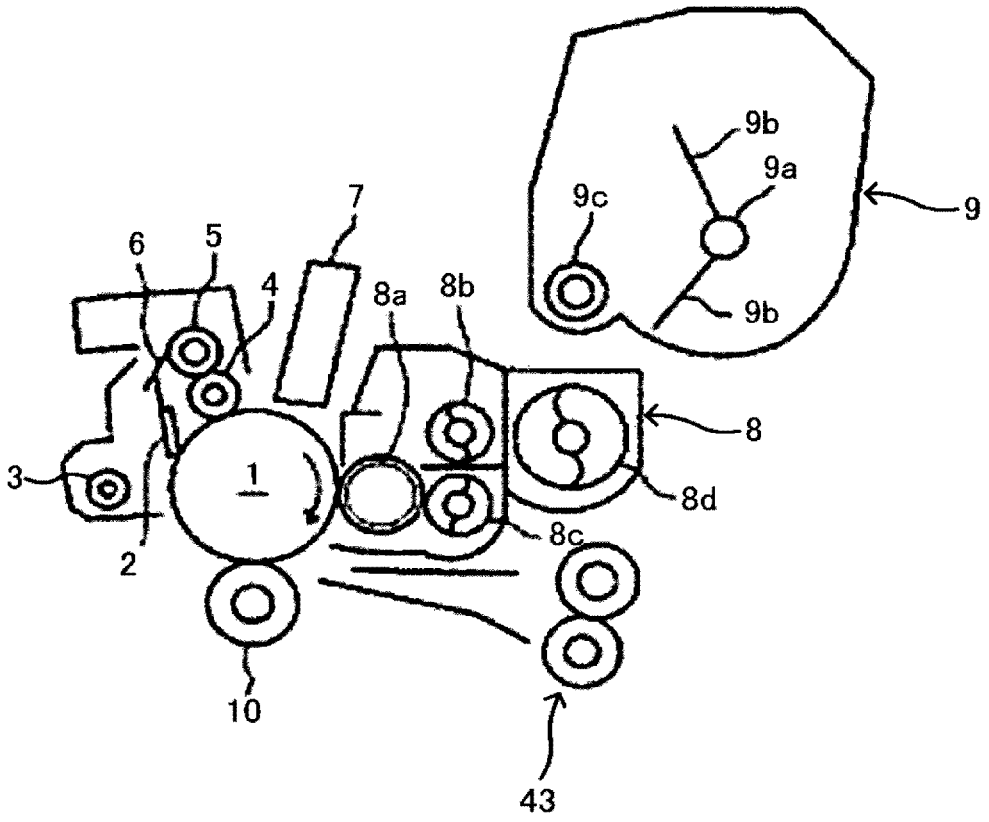
FIG. 2 is an enlarged view illustrating a schematic configuration of a photoconductor provided in the image forming apparatus of FIG. 1 and the periphery of the photoconductor.

FIG. 2 is an enlarged view illustrating a schematic configuration of the photoconductor 1 provided in the image forming apparatus 1000 of FIG. 1 and the periphery of the photoconductor 1.

The drum-shaped photoconductor 1 is rotated in a clockwise direction in FIG. 2. To be more specific, a cleaning blade 2, a toner collection screw 3, a charging roller 4, a charging roller cleaning roller 5, a scraper 6, a latent image writing device 7, a developing device 8, and a transfer roller 10 are provided as the image forming units around the drum-shaped photoconductor 1 which is rotated clockwise in FIG. 2. The charging roller 4 includes a conductive rubber roller and forms a charging nip region by rotating while contacting the photoconductor 1. The charging roller 4 is applied with a charging bias that is output from a power source for the charging roller 4. As a result, the surface of the photoconductor 1 is uniformly charged by the charging bias generated between the surface of the photoconductor 1 and the surface of the charging roller 4 in the charging nip region.

The latent image writing device 7 includes a light-emitting diode (LED) array and performs light scanning with LED light over the surface of the photoconductor 1 that has been uniformly charged. As the latent image writing device 7 emits a laser light beam onto the charged surface of the photoconductor 1, the electric potential of the light irradiated (exposed) region of the charged surface of the photoconductor 1 attenuate, so that an electrostatic latent image is formed by the scanning light on the surface of the photoconductor 1.

As the photoconductor 1 rotates, the electrostatic latent image passes through a development region that is formed between the surface of the photoconductor 1 and the surface of the developing device 8 when the photoconductor 1 is brought to face the developing device 8. The developing device 8 includes a developer circulation conveyance portion and a developing portion. The developer circulation conveyance portion includes developer that contains non-magnetic toner and magnetic carriers. The developer circulation conveyance portion includes a first screw 8*b* for conveying the developer to be supplied to a developing roller 8*a*, and a second screw 8*c* for conveying the developer in an independent space positioned beneath the first screw 8*b*. The developer circulation conveyance portion further includes an inclined screw 8*d* for receiving the developer from the second screw 8*c* and supplying the developer to the first screw 8*b*. The developing roller 8*a*, the first screw 8*b*, and the second screw 8*c* are placed in the developing device 8, at positions axially parallel with each other. By contrast, the inclined screw 8*d* is placed in the developing device 8, at a position inclined with respect to the developing roller 8*a*, the first screw 8*b*, and the second screw 8*c*.

The first screw 8*b* rotates, conveying the developer from a far side toward a near side in a direction orthogonal to the drawing sheet of FIG. 2. At this time, the first screw 8*b* supplies a portion of the developer to the developing roller 8*a* that is disposed facing the first screw 8*b*. After having been conveyed by the first screw 8*b* to the vicinity of the near end portion of the first screw 8*b* in the direction orthogonal to the drawing sheet of FIG. 2, the developer falls onto the second screw 8*c*.

While receiving used developer from the developing roller 8*a*, the second screw 8*c* rotates to convey the received developer from the far side toward the near side in the direction orthogonal to the drawing sheet of FIG. 2, along with rotation of the second screw 8*c*. After having been conveyed by the second screw 8*c* to the vicinity of a near end portion of the second screw 8*c* in the direction orthogonal to the drawing sheet of FIG. 2, the developer is supplied to the inclined screw 8*d*. Then, as the inclined screw 8*d* rotates, the developer is conveyed from the near side toward the far side in the direction orthogonal to the drawing sheet of FIG. 2. Then, the developer is conveyed to the first screw 8*b* in the vicinity of the far end portion of the inclined screw 8*d* in the direction orthogonal to the drawing sheet of FIG. 2.

The developing roller 8*a* includes a developing sleeve and a magnet roller. The developing sleeve is a tubular-shaped rotatable non-magnetic member. The magnet roller is fixed in the developing sleeve in such a way as not to rotate together with the developing sleeve. The developing roller 8*a* scoops up part of the developer that is conveyed by the first screw 8*b* by the surface of the developing sleeve of the developing roller 8*a* due to magnetic force generated by the magnet roller. The developer, which is carried onto the surface of the developing sleeve, is conveyed along with rotation of the developing sleeve and passes through an opposing position at which the developing sleeve and a doctor blade are disposed facing each other. According to this structure, when the developer passes through the opposing position of the developing sleeve and the doctor blade, the thickness of a layer of the developer on the surface of the developing sleeve is regulated by the doctor blade. Thereafter, the developer is conveyed while the developing sleeve of the developing roller 8*a* slides on the surface of the photoconductor 1 in a development region in which the developing roller 8*a* is brought to face the photoconductor 1.

A development bias having the same polarity as the toner and as a uniformly charged electric potential (background electric potential) on the surface of the photoconductor 1 is applied to the developing sleeve. The absolute value of this development bias is greater than the absolute value of the electric potential of the latent image and is smaller than the absolute value of the background electric potential on the background surface of the photoconductor 1. Therefore, in the development region, a development potential acts between the electrostatic latent image formed on the photoconductor 1 and the developing sleeve of the developing device 8, so as to electrostatically move the toner from the developing sleeve to the electrostatic latent image on the surface of the photoconductor 1. By contrast, a background potential acts between the background surface of the photoconductor 1 and the development sleeve of the developing device 8, so as to electrostatically move the toner from the photoconductor 1 to the developing sleeve. This action of the background potential causes the toner to selectively adhere to the electrostatic latent image formed on the surface of the photoconductor 1, so that the electrostatic latent image is developed in the development region.

The developer that has passed through the development region enters an opposite region in which the developing sleeve faces the second screw 8*c* as the developing sleeve rotates. In the opposite region, a repulsive magnetic field is formed by two magnetic poles having the same polarities out of a plurality of magnetic poles included in the magnet roller. The developer that has entered the opposite region is separated from the surface of the developing sleeve due to the effect of the repulsive magnetic field and is collected by the second screw 8*c*.

The developer that is conveyed by the inclined screw 8*d* contains the developer that has been collected from the developing roller 8*a*. Since the developer collected by the developing roller 8*a* is used to develop the image in the development region, the toner concentration is lowered. The developing device 8 includes a toner concentration sensor that detects the toner concentration of the developer to be conveyed by the inclined screw 8*d*. Based on detection results obtained by the toner concentration sensor, a controller 80 outputs a replenishment operation signal for replenishing the toner to the developer that is conveyed by the inclined screw 8*d*, accordingly. The controller 80 functions as circuitry that includes semiconductor circuits such as a central processing unit (CPU).

A toner cartridge 9 is disposed above the developing device 8. The toner cartridge 9 contains toner in a casing and agitates (stirs) the toner with agitators 9*b* fixed to a rotary shaft 9*a*. Further, a toner replenishment member 9*c* is driven to rotate according to the replenishment operation signal output from the controller 80. With this operation, the toner replenishment member 9*c* replenishes an amount of the toner corresponding to a rotation amount of the toner replenishment member 9*c*, to the inclined screw 8*d* of the developing device 8.

A toner image is formed on the surface of the photoconductor 1 as a result of the development by the developing device 8. Then the toner image conveyed to the transfer nip region where the photoconductor 1 and the transfer roller 10 contact each other along with rotation of the photoconductor 1. An electric bias having the opposite polarity to the latent image electric potential of the photoconductor 1 is applied to the transfer roller 10. Accordingly, a transfer bias is formed within the transfer nip region.

As described above, the pair of registration rollers 43 conveys the recording sheet S toward the transfer nip region in synchrony with a timing at which the recording sheet S is overlaid onto the toner image formed on the photoconductor in the transfer nip region. The toner image formed on the photoconductor 1 is transferred onto the recording sheet S that is in close contact with the toner image formed on the photoconductor 1 at the transfer nip region, due to the transfer bias and the nip pressure.

Residual toner that is not transferred onto the recording sheet S remains on the surface of the photoconductor 1 after the recording sheet S and the toner image have passed through the transfer nip region. After being scraped off from the surface of the photoconductor 1 by the cleaning blade 2 that is in contact with the photoconductor 1, the residual toner is conveyed by the toner collection screw 3, toward a waste toner bottle.

The surface of the photoconductor 1 that is cleaned by the cleaning blade 2 is electrically discharged by an electric discharging device. Thereafter, the surface of the photoconductor 1 is uniformly charged again by the charging roller 4. Foreign materials such as toner additive agents and the toner that has not been removed by the cleaning blade 2 remain on the charging roller 4 that is in contact with the surface of the photoconductor 1. These foreign materials are shifted to the charging roller cleaning roller 5 that is in contact with the charging roller 4, and then are scraped off from the surface of the charging roller cleaning roller 5 by the scraper 6 that is in contact with the charging roller cleaning roller 5. The foreign materials scraped off from the surface of the charging roller cleaning roller 5 falls onto the above-described toner collection screw 3.

In FIG. 1, the recording sheet S, which has passed through the transfer nip region formed by the photoconductor 1 and the transfer roller 10 contacting each other, is conveyed to a fixing device 44. The fixing device 44 includes a fixing roller 44*a* and a pressure roller 44*b*. The fixing roller 44*a* includes a heat generating source 44*c* (see FIG. 6) such as a halogen lamp. The pressure roller 44*b* is pressed against the fixing roller 44*a*. The fixing roller 44*a* and the pressure roller 44*b* contact each other to form a fixing nip region. The toner image is fixed to the surface of the recording sheet S that is held in the fixing nip region due to application of heat and pressure. Thereafter, the recording sheet S that has passed through the fixing device 44 passes through a sheet ejection passage R4. Then, the recording sheet S is held in a sheet ejection nip region formed by a pair of sheet ejection rollers 46.

The image forming apparatus 1000 according to the present embodiment is capable of switching printing modes between a single-side printing mode for performing single-side printing and a duplex printing mode for performing duplex printing. In the single-side printing mode, the image forming apparatus 1000 produces an image on one side of the recording sheet S. By contrast, the image forming apparatus 1000 prints respective images on both sides of the recording sheet S in the duplex printing mode. In the single-side printing mode and in the duplex printing mode in which images are formed on both sides of the recording sheet S, the pair of sheet ejection rollers 46 continues rotating in the normal direction (in other words, the forward direction of the pair of sheet ejection rollers 46). By so doing, the recording sheet S in the sheet ejection passage R4 is ejected from the sheet ejection passage R4 to the outside of the image forming apparatus 1000, by the pair of sheet ejection rollers 46. After ejected to the outside of the image forming apparatus 1000, the recording sheet S is stacked on a sheet stacker provided on the top face of the housing 50 of the image forming apparatus 1000.

By contrast, in the duplex printing mode when an image is formed on one side of the recording sheet S, the pair of sheet ejection rollers 46 is rotated in the reverse direction at the timing at which the trailing end of the recording sheet S enters the sheet ejection nip region of the pair of sheet ejection rollers 46. At this time, a switching claw 47 disposed near the downstream end of the sheet ejection passage R4 moves to block (close) the sheet ejection passage R4 and open an entrance of a reverse conveyance passage R5 at the same time. As the recording sheet S starts moving in the reverse direction by rotation of the pair of sheet ejection rollers 46 in the reverse direction, the recording sheet S is conveyed by the pair of sheet ejection rollers 46 into the reverse sheet conveyance passage R5. The downstream end of the reverse sheet conveyance passage R5 meets the common sheet conveyance passage R3, on the upstream side from the pair of registration rollers 43 in the sheet conveyance direction. After being conveyed in the reverse sheet conveyance passage R5, the recording sheet S is conveyed in the reverse sheet conveyance passage R5 to the pair of registration rollers 43 in the common sheet conveyance passage R3 again. Then, after a toner image has been transferred and formed on the other side of the recording sheet S in the transfer nip region, the recording sheet S passes through the fixing device 44, the sheet ejection passage R4, and the pair of sheet ejection rollers 46 and is then ejected to the outside of the housing 50 of the image forming apparatus 1000.

The fixing device 44 that functions as a unit (fixing unit) of the present embodiment further includes a cleaning roller 44*d*. The cleaning roller 44*d* functions as a contact-separation member to remove adhered substances or foreign materials (such as toner and paper dust) adhered to the surface of the pressure roller 44*b* that functions as a contact-separation target member. That is, the cleaning roller 44*d* contacts and separates from the pressure roller 44*b* by a contact-separation mechanism, which is described in detail below.

Further, the fixing device 44 also includes a member including a portion from the fixing nip region of the sheet ejection passage R4 to the switching claw 47. Specifically, the fixing device 44 includes a sheet ejection guide 59, a sheet ejection reversal guide 58, and a pair of relay conveyance rollers 51. The sheet ejection guide 59 is disposed facing a contact face of the recording sheet S to which the recording sheet S after passing through the fixing nip region contacts the fixing roller 44*a*. The sheet ejection guide 59 includes a guide portion 59*a* to guide the recording sheet S to the switching claw 47. The sheet ejection reversal guide 58 includes a sheet ejection guide portion 58*a* and a sheet reversal guide portion 58*b*. The sheet ejection guide portion 58*a* is disposed facing a contact face of the recording sheet S to which the recording sheet S after passing through the fixing nip region contacts the pressure roller 44*b*. The sheet ejection guide portion 58*a* guides the recording sheet S to the switching claw 47. The sheet reversal guide portion 58*b* is disposed facing an image forming face of the recording sheet S after passing through the switching claw 47 in the reverse sheet conveyance passage R5 to guide the recording sheet S. Further, a driven roller 52*b* of a pair of sheet reversal conveyance rollers 52 is attached to the sheet ejection reversal guide 58 to convey the recording sheet S in the reverse sheet conveyance passage R5.

Further, the housing 50 of the image forming apparatus 1000 includes a cover unit 55 on the left side face of the image forming apparatus 1000 in FIG. 1. The cover unit 55 includes a sheet reversal guide 57 that is disposed facing a non-image forming surface of the recording sheet S in the reverse sheet conveyance passage R5 to guide the recording sheet S. A drive roller 52*a* of the pair of sheet reversal conveyance rollers 52 is attached to the sheet reversal guide 57. The cover unit 55 rotates about a shaft 55*a* to open and close with respect to the housing 50 of the image forming apparatus 1000.

Figure 3:
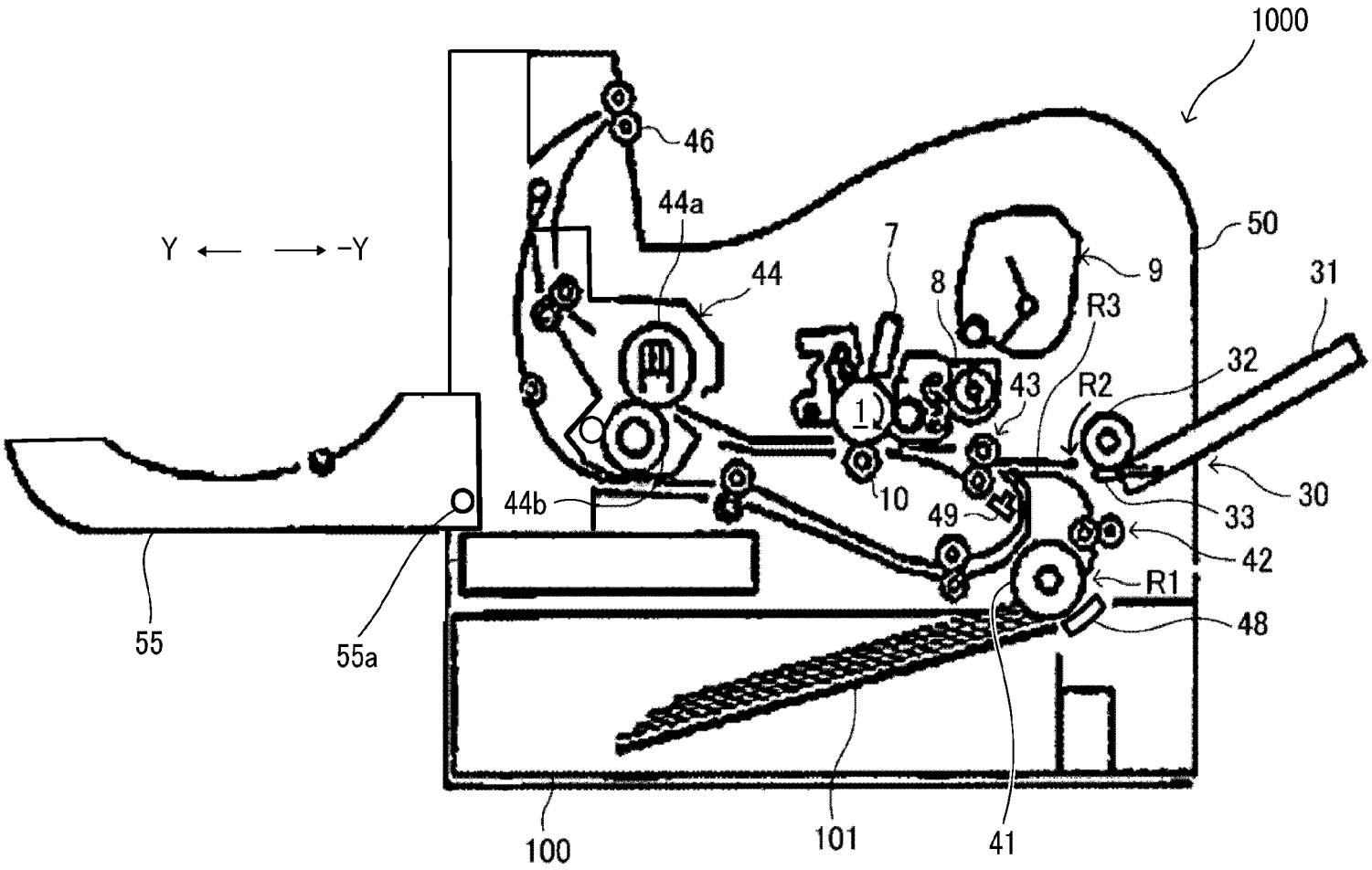
FIG. 3 is a diagram illustrating a schematic configuration of the image forming apparatus of FIG. 1 with a cover unit held open.

FIG. 3 is a diagram illustrating a schematic configuration of the image forming apparatus 1000 with the cover unit 55 held open.

As the cover unit 55 opens, the fixing device 44 is exposed, so that the fixing device 44 is detached from and attached to the housing 50 of the image forming apparatus 1000. Specifically, the fixing device 44 is detached from the housing 50 of the image forming apparatus 1000 in a direction indicated by arrow Y in FIG. 3, which is hereinafter referred to as a "detaching direction". Similarly, the fixing device 44 is attached to the housing 50 of the image forming apparatus 1000 in a direction indicated by arrow −Y in FIG. 3, which is hereinafter referred to as an "attaching direction". Note that the attaching direction of the fixing device 44 is a positioning direction of the fixing device 44, which is a direction to position the fixing device 44 to the housing 50 of the image forming apparatus 1000.

Figure 4:
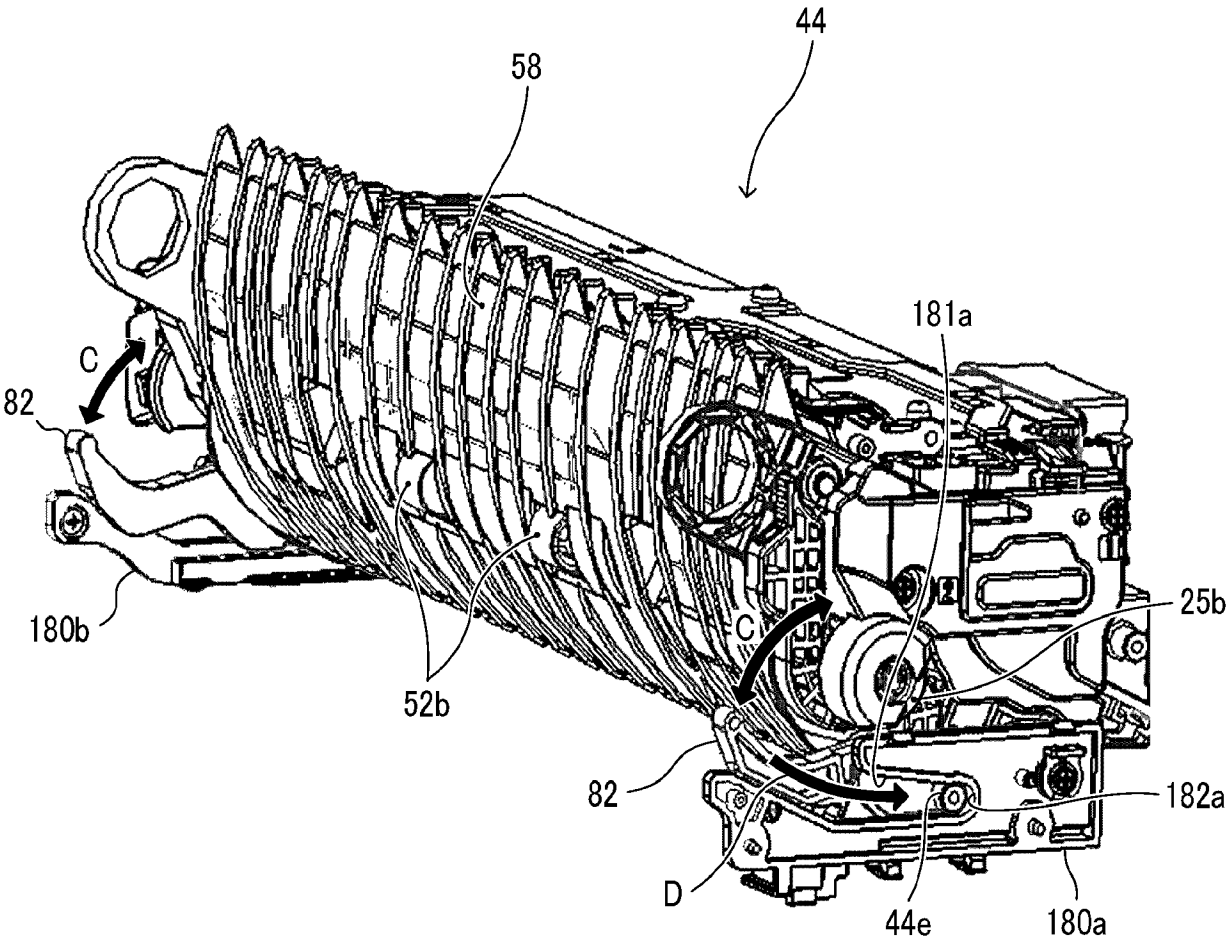
FIG. 4 is a perspective view illustrating a fixing device and positioning members, viewed from one widthwise end of the fixing device, according to an embodiment of the present disclosure.

FIG. 4 is a perspective view illustrating the fixing device 44 and positioning members 180*a* and 180*b*, viewed from one widthwise end (in other words, one axial end) of the fixing device 44, according to the present embodiment.

Figure 5:
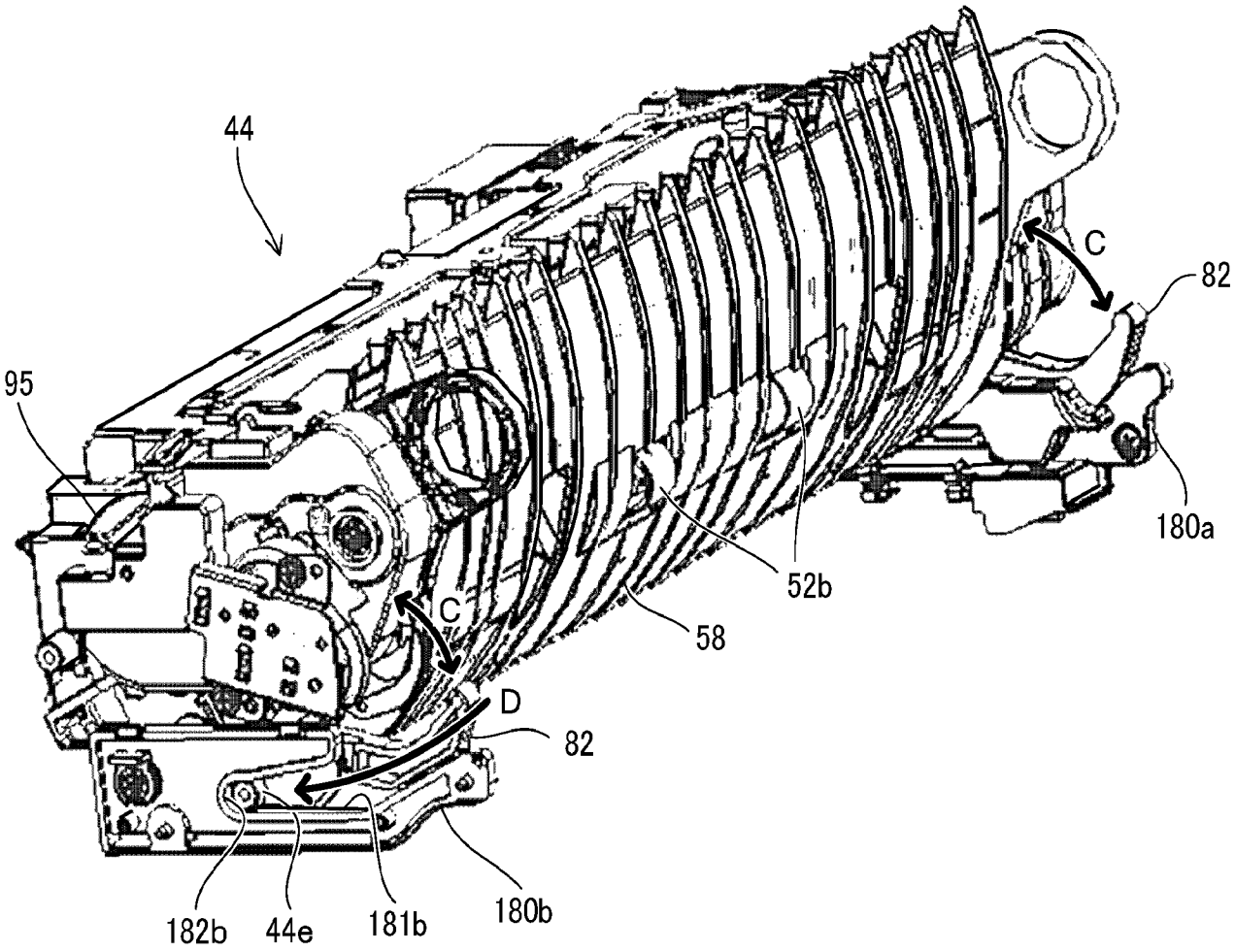
FIG. 5 is a perspective view illustrating the fixing device and the positioning members of FIG. 4, viewed from the opposite widthwise end of the fixing device.

FIG. 5 is a perspective view illustrating the fixing device 44 and the positioning members 180*a* and 180*b*, viewed from the opposite widthwise end (in other words, the opposite axial end) of the fixing device 44, according to the present embodiment.

The positioning members 180*a* and 180*b* are attached to the housing 50 of the image forming apparatus 1000, at both ends in the width direction, respectively. The positioning member 180*a* is provided with a guide groove 181*a* to guide a positioning projection 44*e* provided in the fixing device 44. Similarly, the positioning member 180*b* is provided with a guide groove 181*b* to guide another positioning projection 44*e* provided in the fixing device 44. Note that each positioning projection 44*e* functions as a positioning target portion. The guide groove 181*a* includes a positioning portion 182*a* at the downstream side end of an insertion direction of the positioning projection 44*e*. Similarly, the guide groove 181*b* includes a positioning portion 182*b* at the downstream side end of the insertion direction of the positioning projection 44*e*. Lock levers 82 are provided in the housing 50 of the image forming apparatus 1000 to lock the fixing device 44 in the housing 50. The lock levers 82 are rotatable about the downstream side of an attaching direction of the fixing device 44 as a fulcrum, in a direction indicated by arrow C in FIGS. 4 and 5.

Figure 6:
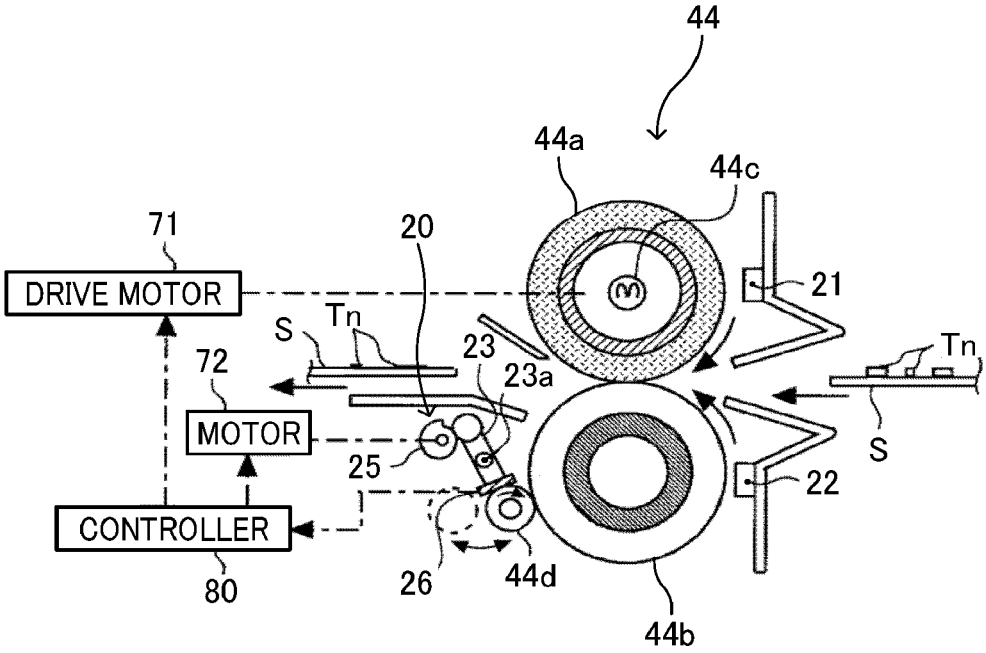
FIG. 6 is a diagram illustrating a schematic configuration the fixing device of FIG. 4.

Note that a driven gear 25*b* in FIG. 4 is a gear that transmits a driving force to each cam 25 that functions as drive member (see FIG. 6). A fixing gear 95 in FIG. 5 is a gear that transmits the driving force to the fixing roller 44*a*. When the fixing device 44 is attached to the housing 50 of the image forming apparatus 1000, the driven gear 25*b* and the fixing gear 95 mesh with respective gears provided in the housing 50 of the image forming apparatus 1000. In order to mesh with the gears on the housing 50, both the driven gear 25*b* and the fixing gear 95 are partially exposed from the casing of the fixing device 44. To be more specific, a part of the driven gear 25*b* on the downstream side in the attaching direction of the fixing device 44 is exposed from the casing of the fixing device 44 and an upper part of the fixing gear 95 is exposed from the casing of the fixing device 44.

When the fixing device 44 is attached (inserted) to the image forming apparatus 1000, the positioning projections 44*e* provided on both widthwise sides (in the width direction) of the fixing device 44 are inserted into the guide groove 181*a* of the positioning member 180*a* and the guide groove 181*b* of the positioning member 180*b*. Then, the fixing device 44 is moved in a direction indicated by arrow D in FIGS. 4 and 5. As the fixing device 44 is attached (inserted) to the image forming apparatus 1000, the respective positioning projections 44*e* contact the positioning portions 182*a* and 182*b*. Consequently, the fixing device 44 is positioned to the image forming apparatus 1000 in the vertical direction and the attaching direction of the fixing device 44. When the fixing device 44 is attached (inserted) to the image forming apparatus 1000 until the respective positioning projections 44*e* contact the positioning portions 182*a* and 182*b*, the lock levers 82 are pulled down. According to this movement of the lock levers 82, a part of each lock lever 82 comes to face a corresponding positioning projection 44*e* from the upstream side in the attaching direction of the fixing device 44. As a result, movement of the fixing device 44 in the detaching direction of the fixing device 44 is restricted by the lock levers 82 to move in a detaching direction of the fixing device 44. Accordingly, the fixing device 44 is locked in the housing 50 of the image forming apparatus 1000.

When detaching the fixing device 44, the cover unit 55 is opened and the lock levers 82 are pushed up to release the fixing device 44 from the locking in the housing 50 of the image forming apparatus 1000. Then, by pulling out the fixing device 44 obliquely upward, the fixing device 44 is detached from the housing 50 of the image forming apparatus 1000.

FIG. 6 is a diagram illustrating a schematic configuration of the fixing device 44 according to the present embodiment.

As illustrated in FIG. 6, the fixing device 44 includes a fixing temperature sensor 21, a pressure temperature sensor 22, and a cleaning temperature detection sensor 26. The fixing temperature sensor 21 detects the surface temperature of the fixing roller 44*a*. The pressure temperature sensor 22 detects the surface temperature of the pressure roller 44*b*. The cleaning temperature detection sensor 26 detects the surface temperature of the cleaning roller 44*d*.

The cleaning temperature detection sensor 26 is a contact type temperature sensor such as a contact type thermistor. The cleaning temperature detection sensor 26 is held by arms 23 of a contact-separation mechanism 20 such that a detection surface of the cleaning temperature detection sensor 26 contacts the cleaning roller 44*d*. Therefore, the cleaning temperature detection sensor 26 continuously contacts the cleaning roller 44*d*, regardless of whether the cleaning roller 44*d* is in contact with the pressure roller 44*b* or apart from the pressure roller 44*b*. Accordingly, the cleaning temperature detection sensor 26 detects the temperature of the cleaning roller 44*d* regardless of whether the cleaning roller 44*d* is in contact with the pressure roller 44*b* or apart from the pressure roller 44*b*.

Further, the fixing device 44 includes the cleaning roller 44*d* and the contact-separation mechanism 20. The cleaning roller 44*d* removes foreign material, such as toner Tn (in FIG. 6) and paper dust, adhered to the surface of the pressure roller 44*b*. The contact-separation mechanism 20 moves the cleaning roller 44*d* between a contact position, at which the cleaning roller 44*d* contacts the surface of the pressure roller 44*b* (i.e., the position indicated with a solid line in FIG. 6), and a separate position, at which the cleaning roller 44*d* separates from the surface of the pressure roller 44*b* (i.e., the position indicated with a broken line in FIG. 6). The contact-separation mechanism 20 includes cams 25 and the arms 23.

The cleaning roller 44*d* is a rotary body made of a metal material and is rotatably held by the arms 23 of the contact-separation mechanism 20. The cleaning roller 44*d* comes into contact with the surface of the pressure roller 44*b* to remove foreign materials, such as toner and paper dust, adhered to the surface of the pressure roller 44*b* and clean the surface of the pressure roller 44*b*. As the surface of the pressure roller 44*b* is cleaned, the fixing roller 44*a* is also cleaned indirectly, thereby reducing occurrence of inconveniences, for example, contamination of the recording sheet S due to toner and paper dust when passing the fixing nip region and lack of a part of the image on the recording sheet S.

The cleaning roller 44*d* is rotated along with rotation of the pressure roller 44*b* while the cleaning roller 44*d* is in contact with the pressure roller 44*b*. Therefore, the cleaning roller 44*d* is rotated to clean the surface of the pressure roller 44*b* efficiently while changing the surface of the cleaning roller 44*d*.

Figure 7:
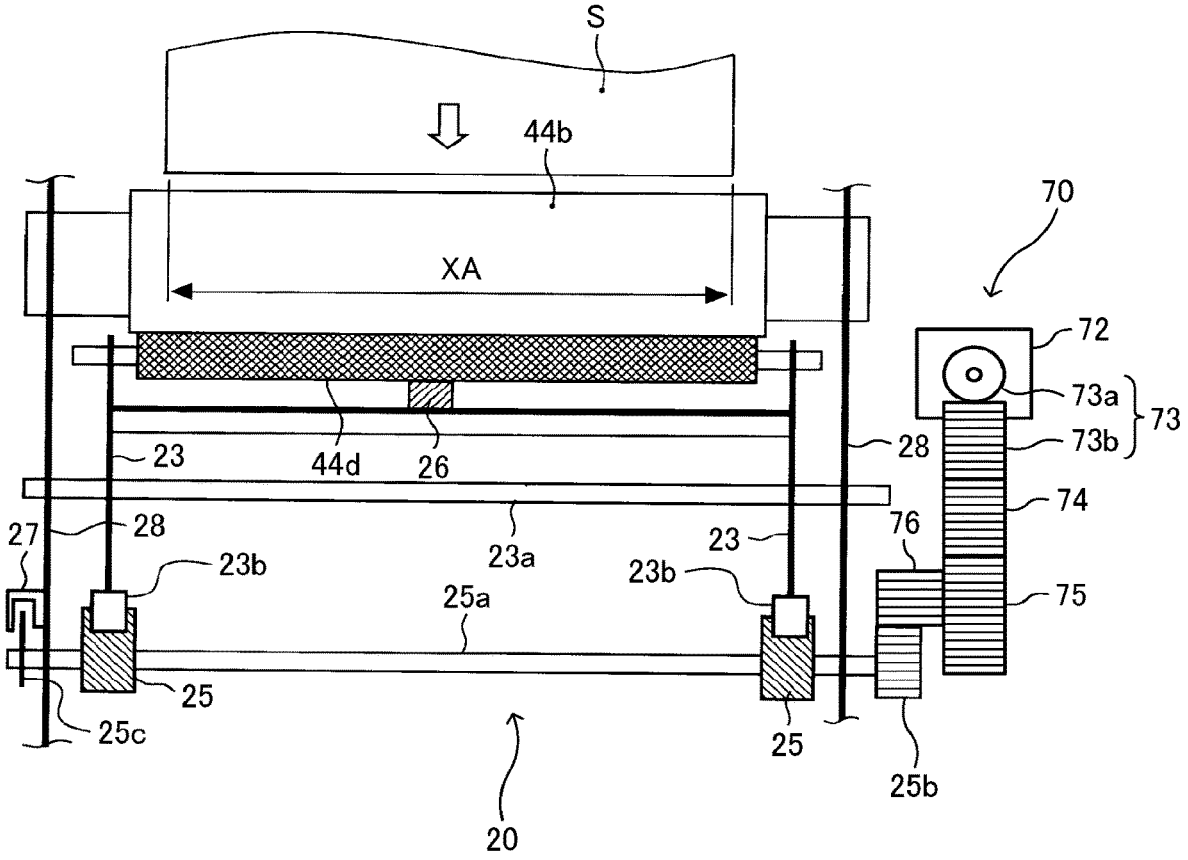
FIG. 7 is a plan view illustrating a schematic configuration of a contact-separation mechanism according to an embodiment of the present disclosure.

Note that, as illustrated in FIG. 7, the cleaning roller 44*d* contacts the pressure roller 44*b* in a range including a maximum sheet conveyance area XA in the fixing nip region. The maximum sheet conveyance area XA refers to a range in a width direction of the recording sheet S having a maximum sheet size conveyable through the fixing nip region. Accordingly, even when the recording sheet S of the maximum size is conveyed through the fixing nip region, the cleaning roller 44*d* reliably cleans the surface of the pressure roller 44*b*.

If the cleaning roller 44*d* keeps in pressure contact with the pressure roller 44*b* for a relatively long period of time even after the fixing device 44 stops driving, the toner placed at the pressure contact portion may be eventually solidified. Further, the cleaning roller 44*d* and the pressure roller 44*b* may be deformed at the pressure contact portion. In order to address this inconvenience, in the present embodiment, when the fixing device 44 stops driving (when the fixing operation is stopped), the cleaning roller 44*d* is located at the separate position at which the cleaning roller 44*d* is separated from the pressure roller 44*b* (the position indicated by the broken line in FIG. 6). Thus, the cleaning roller 44*d* is prevented from continuously contacting the pressure roller 44*b* for a long time, thereby restraining occurrence of the above-described inconvenience.

At a given timing before the fixing device 44 starts the fixing operation (before the start of rotation of the pressure roller 44*b*), the cleaning roller 44*d* at the separate position moves to the contact position. During the fixing operation in which the pressure roller 44*b* rotates, the cleaning roller 44*d* cleans the surface of the pressure roller 44*b*.

The cleaning roller 44*d* is heated by application of heat from the pressure roller 44*b* during the fixing operation, and therefore the temperature of the cleaning roller 44*d* rises. As the surface temperature of the cleaning roller 44*d* rises, the temperature of the toner that has moved from the surface of the pressure roller 44*b* to the surface of the cleaning roller 44*d* increases, melting the toner. As a result, the toner collected by the cleaning roller 44*d* from the surface of the pressure roller 44*b* is likely to move (offset) so as to melt out to the pressure roller 44*b*. Due to this offset, if the toner collected by the cleaning roller 44*d* adheres to the surface of the pressure roller 44*b* again, the toner adhered to the pressure roller 44*b* again is transferred onto the recording sheet S to be conveyed to the fixing nip region, which is likely to result in contamination on the recording sheet S. In addition, a part of the image on the recording sheet S may be lost.

In order to address this inconvenience, in the present embodiment, when the surface temperature of the cleaning roller 44*d* detected by the cleaning temperature detection sensor 26 exceeds a given value during the fixing operation of the fixing device 44 (in other words, during conveyance of the recording sheet S by the fixing roller 44*a* and the pressure roller 44*b*), the cleaning roller 44*d* at the contact position is moved to the separate position. To be more specific, the controller 80 monitors the surface temperature of the cleaning roller 44*d* detected by the cleaning temperature detection sensor 26 during the fixing operation. Then, when the surface temperature of the cleaning roller 44*d* reaches a temperature at which the toner attached to the cleaning roller 44*d* starts to melt (hereinafter, referred to as a "melting temperature"), the controller 80 causes a motor 72 to drive, during the fixing operation, to move the cleaning roller 44*d* from the contact position to the separate position. Accordingly, this configuration prevents the reverse movement of toner collected by the cleaning roller 44*d* to the pressure roller 44*b*, thereby restraining contamination on the recording sheet S and loss of image.

As described above, the controller 80 causes the cleaning roller 44*d* to move to the separate position during the fixing operation, based on the detection result of the cleaning temperature detection sensor 26 that detects the surface temperature of the cleaning roller 44*d* directly. Alternatively, the controller 80 may cause the cleaning roller 44*d* to move to the separate position during the fixing operation, based on the detection result of the pressure temperature sensor 22 that detects the surface temperature of the cleaning roller 44*d*. Generally, there is a high correlation between the change in the surface temperature of the pressure roller 44*b* and the change in the surface temperature of the cleaning roller 44*d*. Therefore, even if the controller 80 causes the cleaning roller 44*d* to move to the separate position during the fixing operation based on the detection result of the pressure temperature sensor 22, when the surface temperature of the cleaning roller 44*d* reaches the melting temperature, the cleaning roller 44*d* is moved to the separate position.

Next, a detailed description is given of the contact-separation mechanism 20 according to the present embodiment of this disclosure.

FIG. 7 is a plan view illustrating a schematic configuration of the contact-separation mechanism 20 according to the present embodiment.

Figure 8:
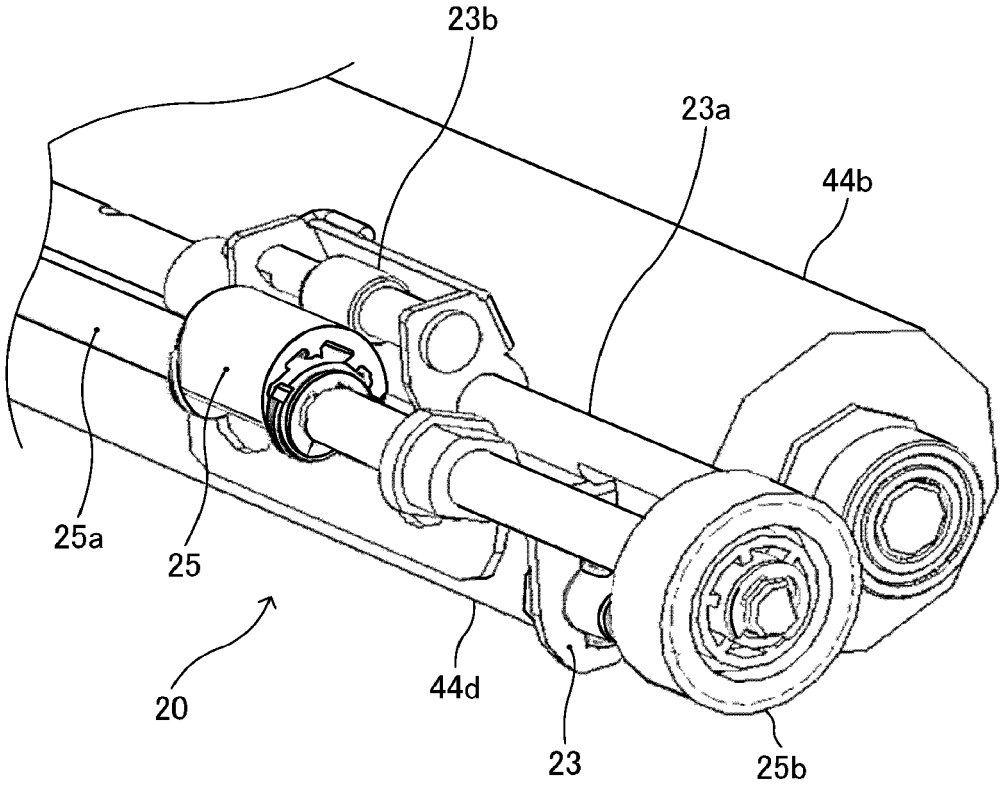
FIG. 8 is a perspective view illustrating one axial end side of the contact-separation mechanism of FIG. 7.

FIG. 8 is a perspective view illustrating one axial end side of the contact-separation mechanism 20 according to the present embodiment.

Figure 9A:
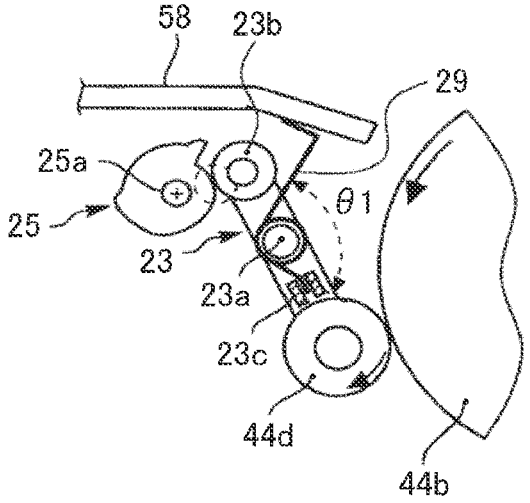
FIGS. 9A and 9B are side views each illustrating a schematic configuration of the contact-separation mechanism of FIG. 7.
Figure 9B:
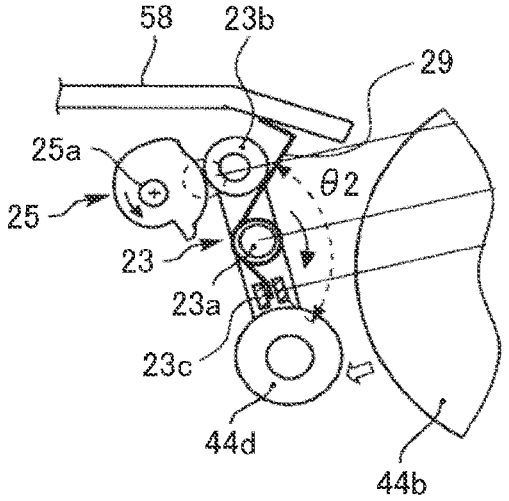

FIGS. 9A and 9B are side views each illustrating a schematic configuration of the contact-separation mechanism 20 according to the present embodiment.

The contact-separation mechanism 20 includes the cams 25, the arms 23, torsion springs 29 each functioning as a biasing member, and the driven gear 25*b* functioning as a unit-side gear. Note that, in the following description, the cams 25, the arms 23, and the torsion springs 29 are also referred to in a singular form, for convenience.

The cam 25 is rotatable about a cam shaft 25*a*. As illustrated in FIG. 7, the cam shaft 25*a* is rotatably supported, through bearings, by unit side plates 28 disposed on opposed widthwise end portions of the fixing device 44. The cams 25 are disposed at opposed widthwise end portions of the cam shaft 25*a*. The widthwise direction of the cam shaft 25*a* is parallel to the width direction of the fixing device 44.

The driven gear 25*b* that functions as a unit-side gear is disposed on one widthwise end side of the cam shaft 25*a*. The driven gear 25*b* is rotatable together with rotation of the cam shaft 25*a*. While the fixing device 44 is set to the housing 50 of the image forming apparatus 1000, the driven gear 25*b* is meshed with a drive gear 76 of a drive device 70. The drive gear 76 functions as a housing-side gear of the drive device 70 that is provided in the housing 50 of the image forming apparatus 1000. The motor 72 is a normal and reverse rotation type motor that rotates the cams 25 in the normal and reverse directions. Each cam functions as a drive member to rotate together with rotation of the cam shaft 25*a*.

A detection target plate 25*c* is disposed on the opposite widthwise end side of the cam shaft 25*a*. The detection target plate 25*c* is rotatable together with rotation of the cam shaft 25*a*. A posture of the detection target plate 25*c* in the rotational direction is optically detected by a photosensor 27 secured to the unit-side plate 28. Accordingly, a posture of the cam 25 in a rotational direction of the cam 25 is detected by the photosensor 27. Note that the posture of the cam 25 in the rotational direction of the cam 25 refers to an angle of the cam 25 (hereinafter referred to as a cam angle), and more particularly to a posture of the cam when the cleaning roller 44*d* is located at the contact position or the separate position. Based on the posture of the cam 25 in the rotational direction of the cam 25 thus detected, the controller 80 causes the motor 72 to accurately move the cleaning roller 44*d* between the contact position and the separate position. As a result, the cleaning roller 44*d* moves to the separate position and the contact position with high accuracy.

Cam followers 23*b* having a substantially cylindrical shape are disposed on one longitudinal end side of the respective arms 23 to contact the respective cams 25. The cleaning roller 44*d* is rotatably disposed on the opposite end side of the arms 23, having a bearing therebetween. A pivot 23*a* is disposed at a longitudinal center portion of the respective arms 23. The pivot 23*a* is secured to and supported by the unit side plates 28 disposed on the opposed widthwise end portions of the fixing device 44 in the width direction of the fixing device 44. The arms 23 are rotatably supported by the pivot 23*a* through respective bearings.

The cam followers 23*b* are made of a resin material having a relatively low surface friction coefficient. There are two cam followers 23*b* provided in the contact-separation mechanism 20, so that the cam follower 23*b* contact the two cams 25 disposed at both widthwise ends of the cam shaft 25*a*.

Note that each arm 23 is made of a metal material such as stainless steel. The bearing interposed between the cleaning roller 44*d* and the arms 23 is made of a conductive resin material. Accordingly, charges are less likely to increase on the cleaning roller 44*d* or foreign materials collected by the cleaning roller 44*d*. In other words, the arms 23 and the bearings are made of such materials prevent unfavorable situations caused by charging of the cleaning roller 44*d* or the foreign materials on the cleaning roller 44*d*.

As illustrated in FIGS. 9A and 9B, each torsion spring 29 functions as a biasing member that biases and rotates the arms 23 to move the cleaning roller 44*d* to the contact position illustrated in FIG. 9A. The torsion springs 29 (i.e., biasing members) are wound around the pivot 23*a*, thus being supported. An arm portion at one end of each torsion spring 29 is hooked on a hook 23*c* of each arm 23 and another arm portion at the opposite end of each torsion spring 29 is hooked on a back side of the sheet ejection reversal guide 58 of the fixing device 44.

When the motor 72 drives in the normal direction under the control of the controller 80 (see FIG. 6), the driving force of the motor 72 is transmitted to the cam shaft 25*a*. By so doing, the cams 25 rotates in the clockwise direction in FIGS. 9A and 9B (i.e., the normal direction), from the state illustrated in FIG. 9B to the state illustrated in FIG. 9A. Then, as a radius of each cam 25 gradually decreases, the biasing force of each torsion spring 29 also gradually decreases. Note that the radius of the cam 25 refers to a cam radius from the cam shaft 25*a* to a cam face. Accordingly, the arm 23 rotates about the pivot 23*a* in the counterclockwise direction in FIGS. 9A and 9B. Eventually, as illustrated in FIG. 9A, the minimum radius portion of each cam 25 comes into contact with each cam follower 23*b*, and the cleaning roller 44*d* contacts the pressure roller 44*b* by the biasing force of the torsion spring 29. In other words, the cleaning roller 44*d* moves to the contact position. When the cleaning roller 44*d* is in contact with the pressure roller 44*b*, an opening angle θ1 of the torsion spring 29 is minimized. Note that the opening angle θ1 of the torsion spring 39 refers to an angle between the arm portion at one end of each torsion spring 29 and another arm portion at the opposite end of each torsion spring 29.

By contrast, when the motor 72 drives in the reverse direction under the control of the controller 80, the driving force from the motor 72 is transmitted to the cam shaft 25*a*. By so doing, the cam 25 rotates in the counterclockwise direction in FIGS. 9A and 9B (i.e., the reverse direction), from the state illustrated in FIG. 9A to the state illustrated in FIG. 9B. Then, as the radius of the cam 25 gradually increases, the biasing force of each torsion spring 29 also gradually increases. The arm 23 rotates about the pivot 23*a* in the clockwise direction in FIGS. 9A and 9B, against the biasing force of the torsion spring 29. Eventually, as illustrated in FIG. 9B, the large radius portion of the cam 25 comes into contact with the cam follower 23*b*, so that the cleaning roller 44*d* separates from the pressure roller 44*b*, in other words, the cleaning roller 44*d* moves to the separate position. When the cleaning roller 44*d* is apart from the pressure roller 44*b*, an opening angle θ2 of the torsion spring 29 is greater than the opening angle θ1 at which the torsion spring 29 opens when the cleaning roller 44*d* is in contact with the pressure roller 44*b*. In short, a relation of θ2>θ1 is satisfied.

Note that, in the present embodiment, when the cleaning roller 44*d* is in contact with the pressure roller 44*b*, the minimum radius portion of the cam 25 contacts the cam follower 23*b* of the arm 23 as illustrated in FIG. 9A.

However, when the cleaning roller 44*d* is in contact with the pressure roller 44*b*, the minimum radius portion of the cam 25 may be configured not to contact the cam follower 23*b* of the arm 23. That is, in a process in which the cleaning roller 44*d* moves from the contact position to the separate position, the cam 25 apart from the cam follower 23*b* comes into contact with the cam follower 23*b*. In such a configuration, the biasing force of the torsion spring 29 mainly determines the contact pressure of the cleaning roller 44*d* against the pressure roller 44*b* at the time when the cleaning roller 44*d* is in contact with the pressure roller 44*b*, thereby facilitating the setting of the contact pressure.

Figure 10A:
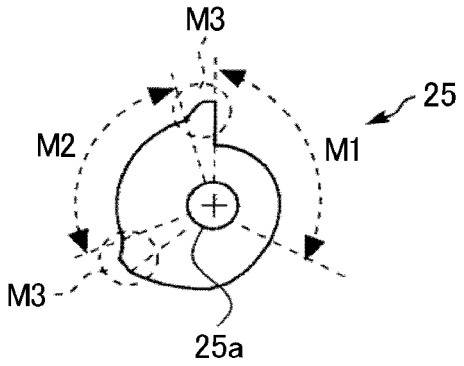
FIG. 10A is a diagram illustrating a schematic structure of a cam according to an embodiment of the present disclosure.
Figure 10B:
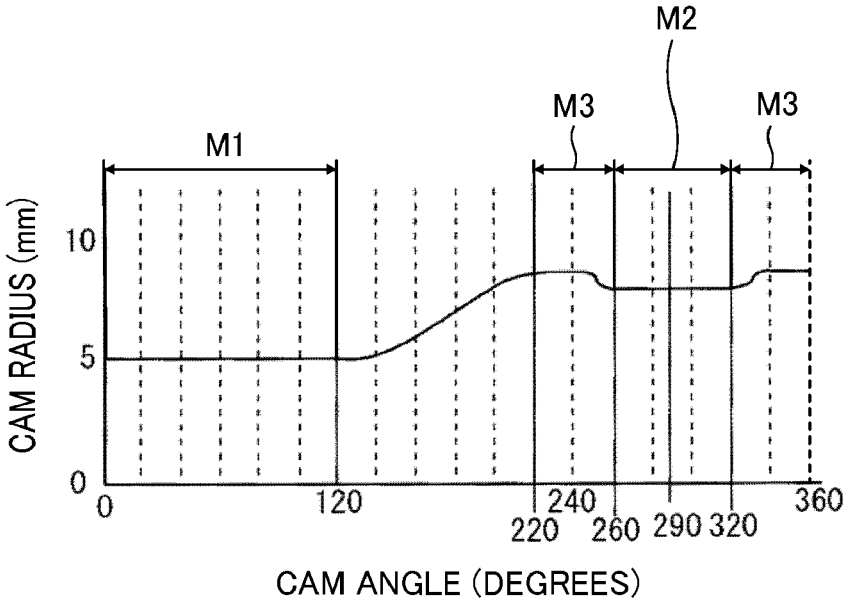
FIG. 10B is a graph illustrating a cam curve of the cam of FIG. 10A.

Now, a detailed description is given of the cam 25, with reference to FIGS. 10A and 10B.

FIG. 10A is a diagram illustrating a schematic structure of the cam 25 according to the present embodiment.

FIG. 10B is a graph of a cam curve of the cam 25 according to the present embodiment.

Specifically, the cam curve in FIG. 10B indicates a shape of the cam face of the cam 25. In FIG. 10B, the horizontal axis indicates the angle of the cam 25 (i.e., cam angle) and the vertical axis indicates the radius of the cam 25 (i.e., cam radius).

As illustrated in FIGS. 10A and 10B, the cam face (outer circumferential surface) of the cam 25 has a minimum radius portion M1, a large radius portion M2, and a maximum radius portion M3. As illustrated in FIGS. 10A and 10B, the large radius portion M2 on the cam face (i.e., outer circumferential surface) of the cam 25 is in a range of 60° or greater around the cam shaft 25*a*. As described above, the cam 25 has the large radius portion M2 to locate the cleaning roller 44*d* at the separate position illustrated in FIG. 9B. Specifically, in the present embodiment, the large radius portion M2 of the cam 25 is in a range of about 60° around the cam shaft 25*a*. The maximum radius portion M3 has a larger radius (or cam radius) than the cam radius of the large radius portion M2 and is adjacent to the large radius portion M2. In the present embodiment, each circumferential side of the large radius portion M2 is adjacent to the maximum radius portion M3.

The motor 72 drives and rotates the cam 25 (in the normal direction) to move the cleaning roller 44*d* from the separate position to the contact position. Then, the cam 25 rotates from a state in which the large radius portion M2 of the cam 25 is in contact with the cam follower 23*b* to a state in which the maximum radius portion M3 of the cam 25 is in contact with the cam follower 23*b*. By moving the cam 25 to the state in which the maximum radius portion M3 of the cam 25 is in contact with the cam follower 23*b*, the biasing force of the torsion spring 29 temporarily increases. Thereafter, as the cam 25 further rotates in the normal direction and decreases in radius, the biasing force of the torsion spring 29 gradually decreases, and the arm 23 rotates about the pivot 23*a* in the counterclockwise direction in FIG. 6. Eventually, the minimum radius portion M1 of the cam 25 is in contact with the cam follower 23*b*, and the biasing force of the torsion spring 29 causes the cleaning roller 44*d* to contact the pressure roller 44*b*.

When the cleaning roller 44*d* moves from the contact position to the separate position, the operation with the processes in the reverse order is performed.

As described above, the cleaning roller 44*d* is located at the separate position, except while the fixing operation is performed. Therefore, when the fixing device 44 is attached to or detached from the housing 50 of the image forming apparatus 1000, the cam follower 23*b* contacts the large radius portion M2 of the cam 25, and the cleaning roller 44*d* is located at the separate position. For example, when detaching the fixing device 44 from the housing 50 of the image forming apparatus 1000, an operator may accidentally touch the contact-separation mechanism 20 (for example, the driven gear 25*b*). Further, when removing a recording sheet S or sheets S jammed in the fixing device 44 (paper jam), the operator may accidentally touch the contact-separation mechanism 20. If the operator mistakenly touches the contact-separation mechanism 20, unexpected external force may be applied to the contact-separation mechanism 20, and therefore the cleaning roller 44*d* is likely to move from the separate position to the contact position. However, in the present embodiment, the maximum radius portion M3 of the cam 25 is provided in the portion adjacent to the large radius portion M2 of the cam 25. Therefore, in order for the cleaning roller 44*d* to move from the separate position to the contact position, the cam follower 23*b* is to ride over the maximum radius portion M3 of the cam 25. As a result, the cleaning roller 44*d* is restrained from moving from the separate position to the contact position when unexpected external force is applied to the contact-separation mechanism 20.

Further, the range of the large radius portion M2 of the cam 25 is 60° or more. As described above, since the range of the large radius portion M2 of the cam 25 is 60° or more, even when unexpected external force is applied to the contact-separation mechanism 20, the cleaning roller 44*d* is restrained from moving from the separate position to the contact position.

Figure 11:
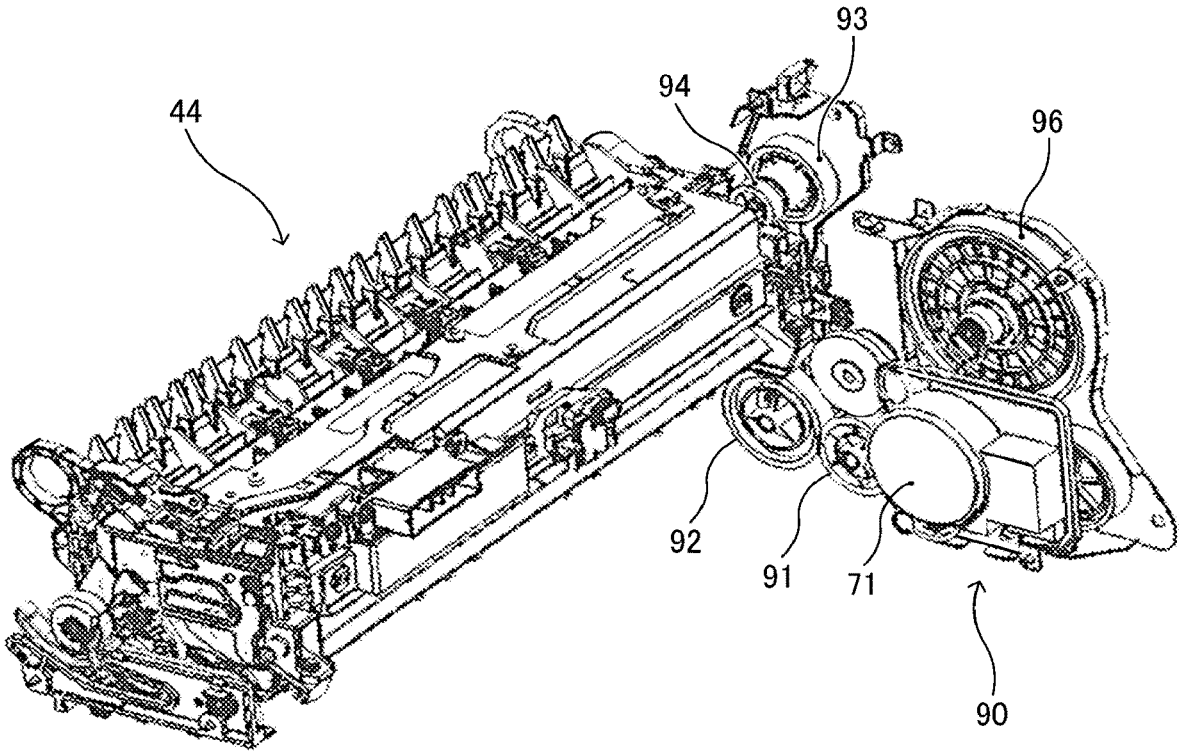
FIG. 11 is a perspective view illustrating a main drive device that drives, for example, a fixing roller, and the fixing device of FIG. 4.

FIG. 11 is a perspective view illustrating a main drive device 90, which drives, for example, the fixing roller 44*a*, and the fixing device 44.

The driving force of a drive motor 71 of the main drive device 90 is transmitted to the photoconductor 1 via a photoconductor gear 96 to rotate the photoconductor 1. The driving force of the drive motor 71 is transmitted to a fixing output gear 94 via gears 91, 92, and 93, and is then transmitted from the fixing output gear 94 to the fixing gear 95 (see FIG. 5). As a result, the driving force of the drive motor 71 is transmitted to the fixing roller 44*a* via the fixing gear 95, thereby rotating the fixing roller 44*a*.

Figure 12:
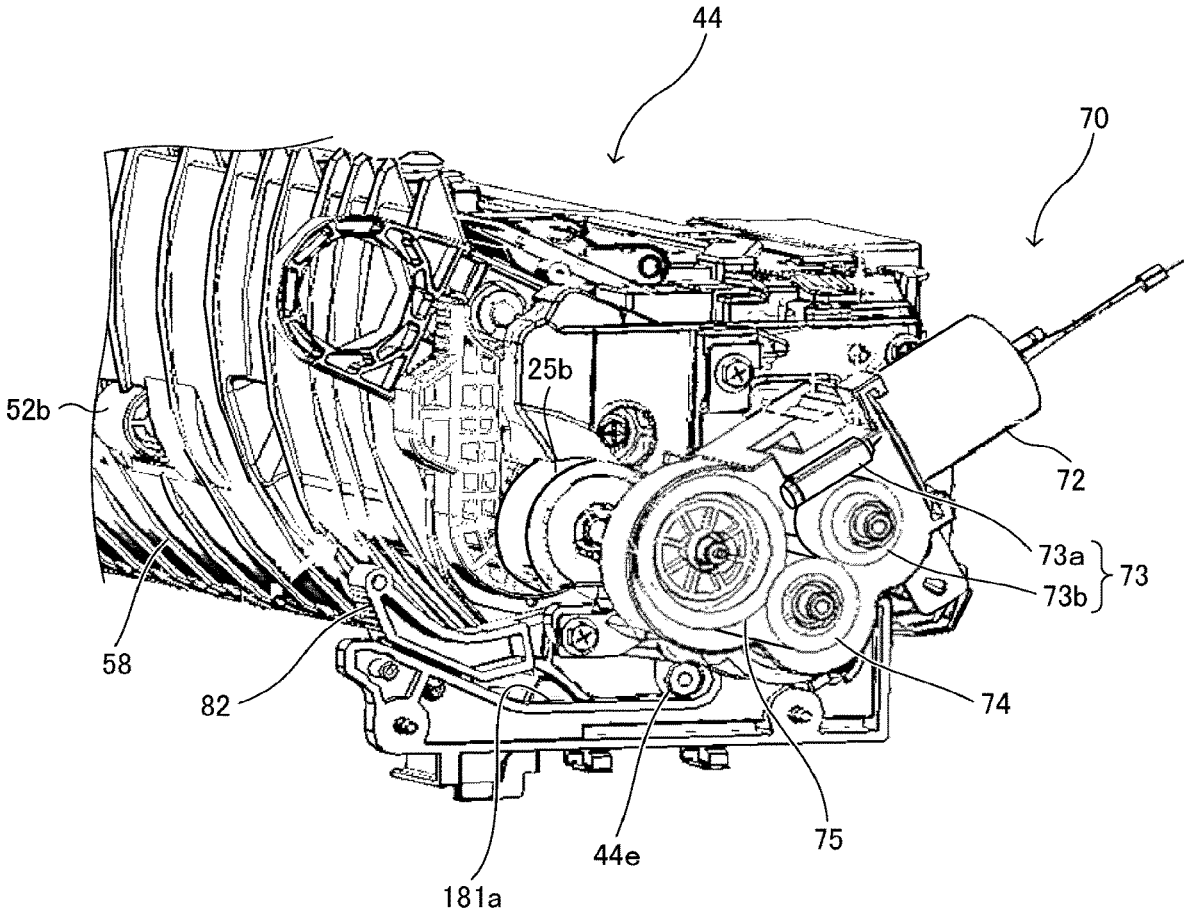
FIG. 12 is a perspective view illustrating a drive device and the fixing device of FIG. 4.

FIG. 12 is a perspective view illustrating the drive device 70 and the fixing device 44, according to the present embodiment.

Figure 13:
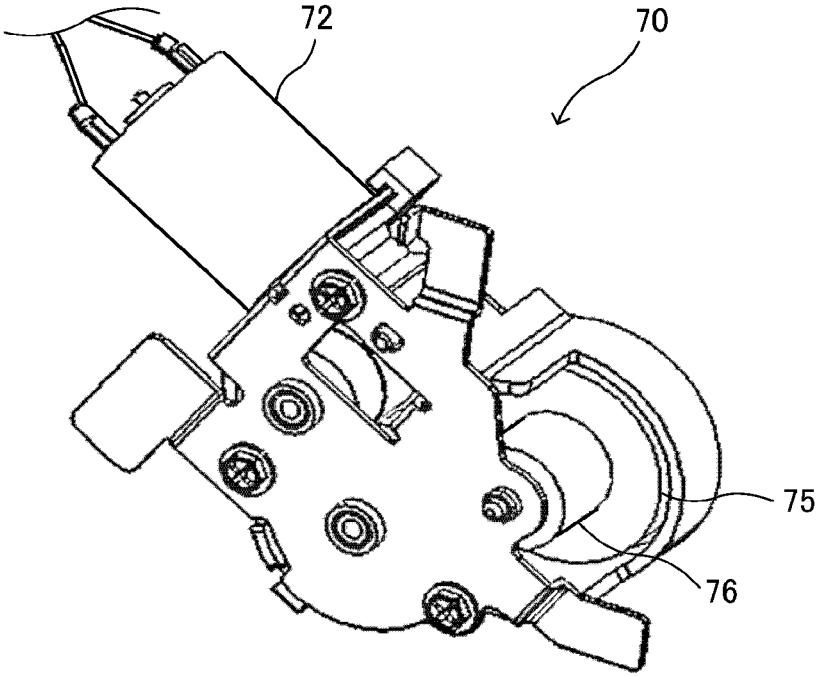
FIG. 13 is a perspective view illustrating the drive device of FIG. 7.

FIG. 13 is a perspective view illustrating the drive device 70 according to the present embodiment.

The drive device 70 that drives the cam 25 functioning as a drive member includes the motor 72, a worm gear 73, an idler gear 74, an output gear 75, and the drive gear 76. The worm gear 73 includes a worm 73*a* and a worm wheel 73*b*. The worm 73*a* is attached to the shaft of the motor 72. The idler gear 74 meshes with the worm wheel 73*b* of the worm gear 73 and with the output gear 75. The output gear 75 is mounted coaxially with the drive gear 76 that meshes with the driven gear 25*b* and is provided as a single unit with the drive gear 76.

Since the fixing roller 44*a* rotates in a single direction, the fixing output gear 94 mounted on the housing side (on the housing 50) meshes with the fixing gear 95 mounted on the unit side (on the fixing device 44) from above. By thus meshing the fixing output gear 94 with the fixing gear 95 from above, a component in a direction in which the fixing device 44 is attached to the housing 50 of the image forming apparatus 1000 (i.e., the attaching direction of the fixing device 44) in force applied form the fixing output gear 94 to the fixing gear 95 (in a direction substantially toward the pressure angle).

On the other hand, since the cam 25 rotates in both normal and reverse directions, the drive gear 76 on the housing side (on the housing 50) meshes with the driven gear 25*b* on the unit side (on the fixing device 44), from the downstream side in the attaching direction of the fixing device 44.

FIGS. 14A, 14B, 14C, and 14D are diagrams illustrating the force applied from the drive gear 76 to the driven gear 25*b*, according to the present embodiment.

In FIGS. 14A to 14D, the drive gear 76 and the driven gear 25*b* are viewed from the inside in the width direction of the fixing device 44 (i.e., the opposite widthwise end of the fixing device 44). The fixing device 44 is attached to the housing 50 of the image forming apparatus 1000 from right to left in FIGS. 14A to 14D (the attaching direction). Further, in the example illustrated in FIGS. 14A to 14D, the drive gear 76 and the driven gear 25*b* are disposed such that a line segment L1 connecting a center of rotation O1 of the drive gear 76 and a center of rotation O2 of the driven gear 25*b* is parallel to the attaching direction of the fixing device 44.

Figure 14A:
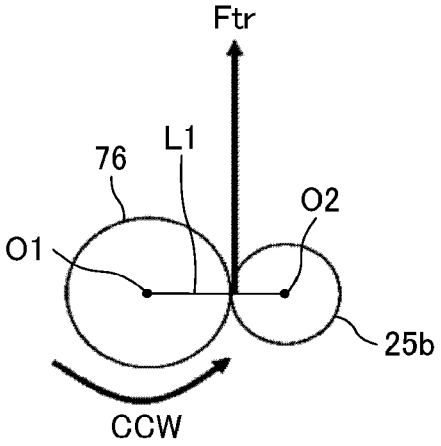
FIGS. 14A, 14B, 14C, and 14D are diagrams each illustrating a force applied from a drive gear to a driven gear, according to an embodiment of the present disclosure.
Figure 14B:
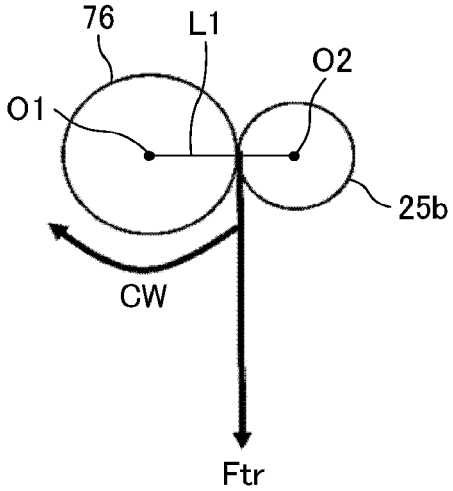

FIG. 14A illustrates a rotation state of each gear when the motor 72 and the cam 25 are rotated in the reverse direction to move the cleaning roller 44*d* from the contact position to the separate position. FIG. 14B illustrates a rotation state of each gear when the motor 72 and the cam 25 are rotated in the normal direction to move the cleaning roller 44*d* from the separate position to the contact position.

As illustrated in FIGS. 14A and 14B, the force Ftr applied from (the tooth of) the drive gear 76 to (the tooth of) the driven gear 25*b* acts substantially in the same direction as the direction of the pressure angle. As described above, in FIGS. 14A to 14D, the drive gear 76 and the driven gear 25*b* are disposed such that the line segment L1 connecting the center of rotation O1 of the drive gear 76 and the center of rotation O2 of the driven gear 25*b* is parallel to the attaching direction of the fixing device 44. In the arrangement illustrated in FIGS. 14A and 14B, if the pressure angle is 0°, when the drive gear 76 rotates in the counterclockwise direction (CCW) in FIG. 14A, the force Ftr applied from (the tooth of) the drive gear 76 to (the tooth of) the driven gear 25*b* directs vertically upward as in FIG. 14A. On the other hand, when the drive gear 76 rotates in the clockwise direction (CW) in FIG. 14B, the force Ftr directs vertically downward as in FIG. 14B. Therefore, even when the motor 72 and the cam 25 rotate in both the normal and reverse directions, a component (component force) in the detaching direction of the fixing device 44 is not exerted in the force applied from the drive gear 76 to the driven gear 25*b*. Note that the detaching direction of the fixing device 44 is opposite to the attaching direction of the fixing device 44).

Figure 14C:
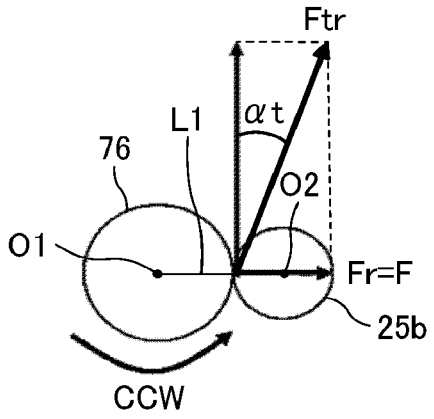
Figure 14D:
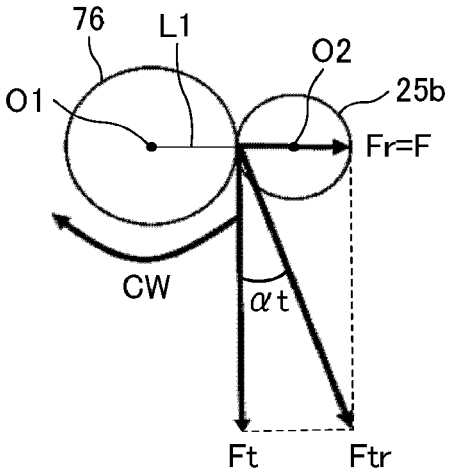

However, an actual pressure angle of about 20° exists in the rotation states and, as illustrated in FIGS. 14C and 14D, even when the motor 72 and the cam 25 rotate in either of the normal and reverse directions, the force Ftr applied from (the tooth of) the drive gear 76 to (the tooth of) the driven gear 25*b* includes a device detaching component force F that is component force in the direction in which the fixing device 44 is detached, that is, in the detaching direction of the fixing device 44. In FIGS. 14C and 14D, the drive gear 76 and the driven gear 25*b* are disposed such that the line segment L1 connecting the center of rotation O1 of the drive gear 76 and the center of rotation O2 of the driven gear 25*b* is parallel to the attaching direction of the fixing device 44. Therefore, radial force Fr that is force in the radial direction of the force Ftr equals to the device detaching component force F that is that component force in the detaching direction of the fixing device 44.

In the present embodiment, as described with reference to FIGS. 4 and 5, the movement of the fixing device 44 in the detaching direction is restricted by the lock lever 82 as described below. That is, after the fixing device 44 is positioned, the lock lever 82 is pushed down to bring a part of the lock lever 82 to face the positioning projection from the upstream side in the attaching direction of the fixing device 44, so that movement of the fixing device 44 in the detaching direction is restricted. However, a gap is inevitably formed between the lock lever 82 and the positioning protrusion due to manufacturing error or assembly error. As a result, when the component of force F in the detaching direction of the fixing device 44 is exerted in the force Ftr applied from (the tooth of) the drive gear 76 to (the tooth of) the driven gear 25*b*, the fixing device 44 is likely to move in the detaching direction due to the action of the device detaching component force F.

In the present embodiment, as described above, the fixing output gear 94 meshes with the fixing gear 95 from above on the opposite widthwise end of the fixing device 44. Due to this gear meshing, when the fixing roller 44*a* is driven, the device detaching component force F in the detaching direction of the fixing device 44 is exerted in the force Frt applied from (the tooth of) the fixing output gear 94 to (the tooth of) the fixing gear 95. Consequently, the fixing device 44 is fixed to the positioning portion 182*b* on the opposite widthwise end of the fixing device 44. Therefore, due to the device detaching component force F of the force Ftr that is applied from (the tooth of) the drive gear 76 to (the tooth of) the driven gear 25*b*, one widthwise end of the fixing device 44 moves in the detaching direction of the fixing device 44. As a result, the fixing device 44 tilts with respect to the width direction of the fixing device 44.

Figure 15A:
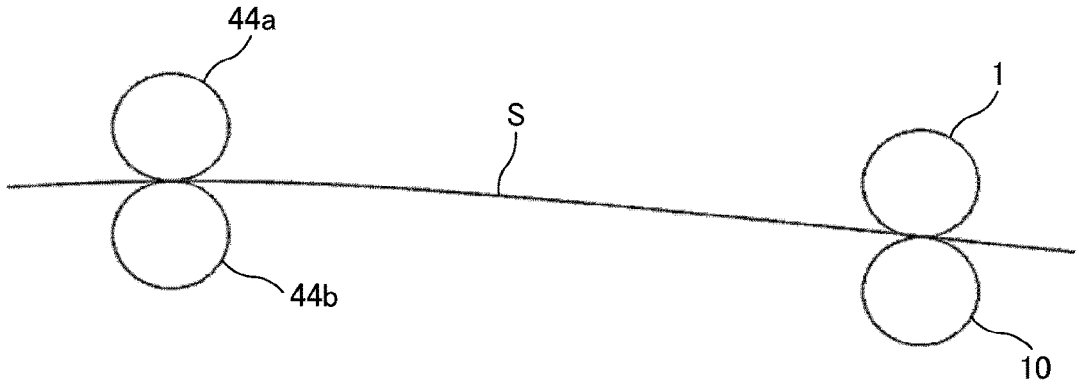
FIGS. 15A and 15B are diagrams each explaining a failure that may occur when the fixing device of FIG. 4 is inclined with respect to the width direction of the fixing device.
Figure 15B:
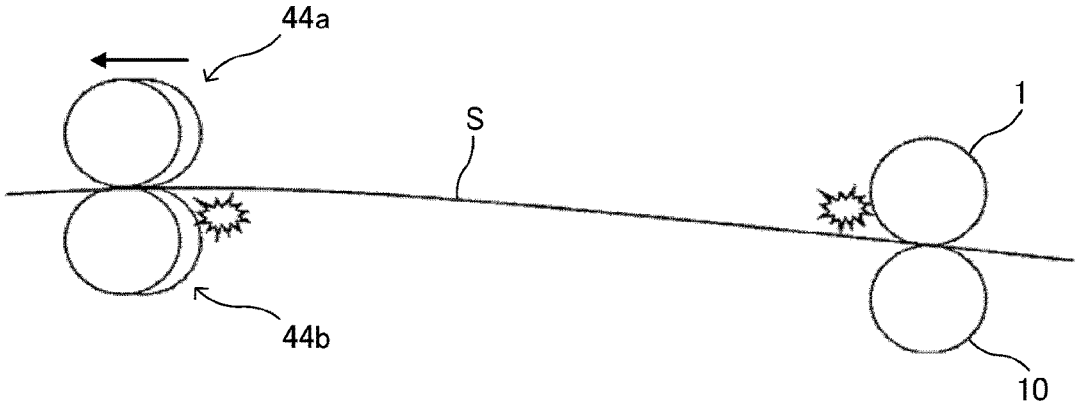

FIGS. 15A and 15B are diagrams each explaining a failure that may occur when the fixing device 44 is inclined with respect to the width direction of the fixing device 44, according to the present embodiment.

As described above, in the present embodiment, the drive device 70 drives the cam to move the cleaning roller 44*d* to contact and separate from the pressure roller 44*b* while the fixing device 44 performs the fixing operation and the recording sheet S is passing the fixing device 44. Therefore, due to the device detaching component force F of the force Ftr that is applied from (the tooth of) the drive gear 76 to (the tooth of) the driven gear 25*b* during the fixing operation, one widthwise end of the fixing device 44 moves in the detaching direction of the fixing device 44 to incline with respect to the width direction of the fixing device 44. As a result, as illustrated in FIG. 15A, such one widthwise end of the recording sheet S is pulled when the recording sheet S is conveyed while being held in the transfer nip region and in the fixing nip region. Accordingly, as illustrated in FIG. 15B, at least one of a transfer failure and a fixing failure may occur on the one widthwise end of the recording sheet S, which may generate at least one of roughness and creases on the recording sheet S.

In the present embodiment, when the motor 72 and the cam 25 rotate in the normal direction, the cleaning roller 44*d* is moved from the separate position to the contact position, and the cam follower 23*b* moves on the cam face where the radius of the cam 25 gradually decreases. As a result, the load torque is small when the cam 25 rotates in the normal direction to move the cleaning roller 44*d* from the separate position to the contact position, as illustrated in FIG. 14B. Accordingly, the force Ftr applied from (the tooth of) the drive gear 76 to (the tooth of) the driven gear 25*b* is small, and the device detaching component force F of the force Ftr, which is equal to the radial force Fr of the force Ftr, is smaller than the static friction force between the positioning projection 44*e* and the positioning portion 182*a*. Therefore, a widthwise end of the fixing device 44 does not move.

On the other hand, when the motor 72 and the cam 25 rotate in the reverse direction to move the cleaning roller 44*d* from the contact position to the separate position, and the cam follower 23*b* moves on the cam face where the radius of the cam 25 gradually increases. When the cam 25 rotates in the reverse direction, as described above, to move the cleaning roller 44*d* from the contact position to the separate position, as illustrated in FIG. 14A, the cam follower 23*b* climbs on the cam face. Therefore, the load torque applied when the cam rotates in the reverse direction to move the cleaning roller 44*d* from the contact position to the separate position is larger than the load torque applied when the cam 25 rotates in the normal direction to move the cleaning roller 44*d* from the separate position to the contact position, as illustrated in FIG. 14B. As described above, since the load torque is larger when moving the cleaning roller 44*d* from the contact position to the separate position, the force Ftr applied from (the tooth of) the drive gear 76 to (the tooth of) the driven gear 25*b* is relatively large. As a result, the device detaching component force F of the force Ftr is larger than the static friction force between the positioning projection 44*e* and the positioning portion 182*a*, which moves one widthwise end of the fixing device 44, generating the above-described inconvenience.

In order to address this inconvenience, the cam 25 may be configured as follows, so that the cleaning roller 44*d* may be brought into and out of contact with the pressure roller 44*b* without rotating the cam 25 in the reverse direction. That is, the cam 25 is configured to rotate by half to move the cleaning roller 44*d* from the contact position to the separate position, and further rotate by another half to move the cleaning roller 44*d* from the separate position to the contact position. With this configuration, however, when the same configuration as the present embodiment is applied to prevent the cleaning roller 44*d* from easily moving between the separate position and the contact position due to application of the external force, the following inconvenience is likely to occur. Note that the same configuration as the present embodiment is a configuration in which the cam 25 has the maximum radius portion M3, and the large radius portion M2 and the minimum radius portion M1 having certain respective lengths. With this configuration, the inclination from the minimum radius portion M1 to the large radius portion M2 is steeper and the moving speed of the cleaning roller 44*d* is faster, than a generally known configuration. As a result, the cleaning roller 44*d* is brought to contact with the pressure roller 44*b* with great force, causing noise and damage on the cleaning roller 44*d*, the pressure roller 44*b*, or both. By reducing the length of the minimum radius portion M1 and the length of the large radius portion M2, the inclination from the minimum radius portion M1 to the large radius portion M2 may be reduced. However, this configuration shortens the stop section so that the cam 25 may not stop at the target position. The above-described inconvenience may be eliminated if the size of the cam 25 is increased. However, an increase in size of the cam 25 leads to an increase in size of the image forming apparatus 1000. In the present embodiment, by rotating the cam 25 in the normal and reverse directions, even the cam 25 that is small in size may provide certain lengths of the minimum radius portion M1 and the large radius portion M2 and the inclination of the cam 25 from the minimum radius portion M1 to the large radius portion M2 may be reduced. Therefore, the cam 25 stops at the target position, restraining noise and damage.

Figure 16:
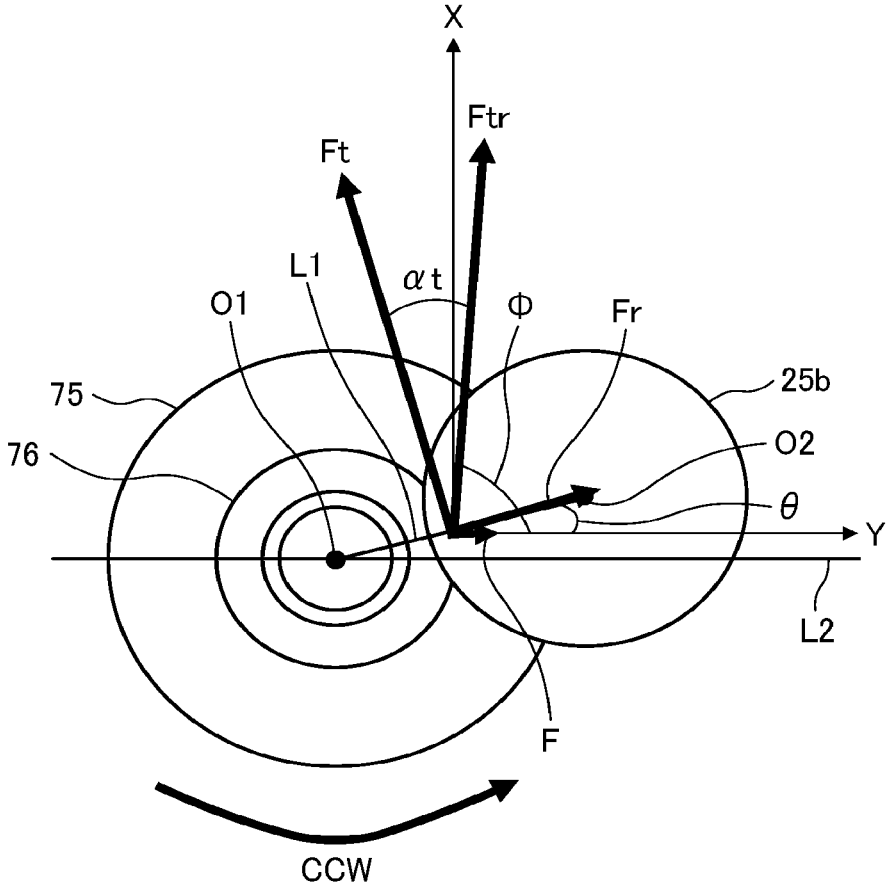
FIG. 16 is a diagram illustrating the relative positions of the drive gear and the driven gear of FIG. 14A.

FIG. 16 is a diagram illustrating the relative positions of the drive gear 76 and the driven gear 25*b*, according to the present embodiment.

Similar to FIGS. 14A to 14D, FIG. 16 is the diagram in which the drive gear 76 and the driven gear 25*b* are viewed from the inside in the width direction of the fixing device 44 (i.e., the opposite widthwise end of the fixing device 44).

In the present embodiment, as illustrated in FIG. 16, the center of rotation O2 of the driven gear 25*b* is located above a line L2 parallel to the attaching direction of the fixing device 44. The line L2 passes the center of rotation O1 of the drive gear 76. Accordingly, the center of rotation O2 of the driven gear 25*b* is disposed downstream from the line L2 that is parallel to the attaching direction of the fixing device 44, in the rotational direction of the drive gear 76 when the load torque is large (i.e., the counterclockwise direction in FIG. 16). In FIG. 16, the force Ftr is the force applied from (the tooth of) the drive gear 76 to (the tooth of) the driven gear 25*b* and force Ft is the tangential force. The radial force Fr is the force in the radial direction of the driven gear 25*b* at the meshing portion of the drive gear 76 and the driven gear 25*b*. The device detaching component force F is a component of the force Ftr in the detaching direction of the fixing device 44. Further, in FIG. 16, angle at is an angle between the line of the direction of the force Ftr applied from the drive gear 76 to the driven gear 25*b* and the tangent line of the direction at the meshing portion of the drive gear 76 and the driven gear 25*b*. The angle at is nearly equal to the pressure angle. Further, in FIG. 16, angle $\phi$ is an angle between the line of direction of the force Ftr applied from the drive gear 76 to the driven gear 25*b* and the line of attaching direction of the fixing device 44, and angle $\theta$ is a gear angle. Note that the gear angle $\theta$ is an angle between a line Y that runs in parallel to the attaching direction of the fixing device 44 and the line segment L1 connecting the center of rotation O1 of the drive gear 76 and the center of rotation O2 of the driven gear 25*b*.

Figure 17A:
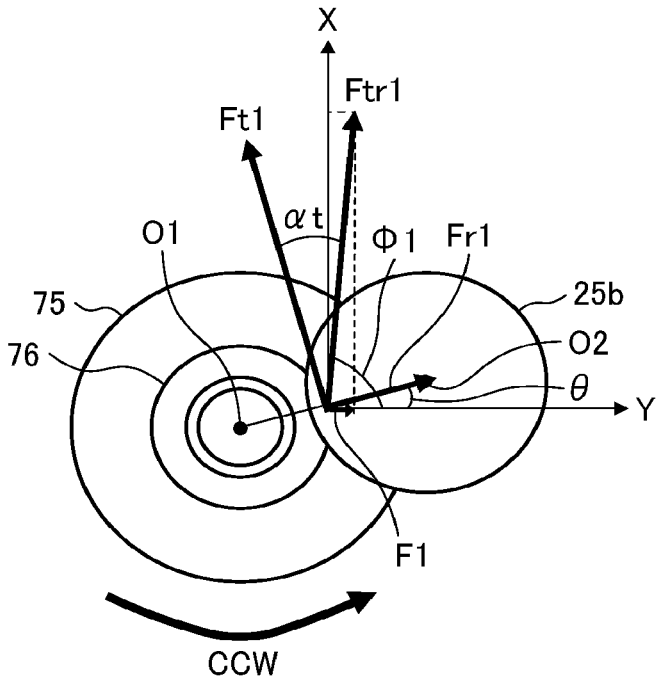
FIGS. 17A and 17B are diagrams illustrating a force applied from the drive gear to the driven gear of FIG. 14A.
Figure 17B:
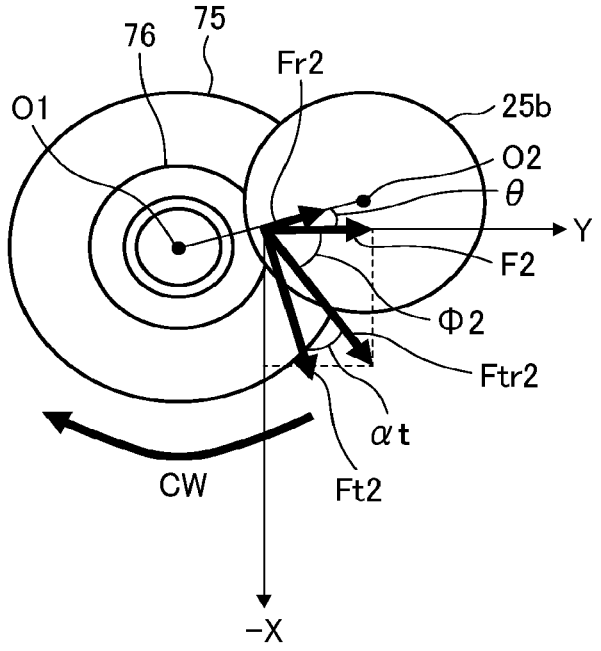

FIGS. 17A and 17B are diagrams illustrating the force Ftr applied from (the tooth of) the drive gear 76 to (the tooth of) the driven gear 25*b*, according to the present embodiment.

FIG. 17A is a diagram for explaining the force Ftr when the drive gear 76 rotates in the counterclockwise direction to move the cleaning roller 44*d* from the contact position to the separate position. FIG. 17B is a diagram for explaining the force Ftr when the drive gear 76 rotates in the clockwise direction to move the cleaning roller 44*d* from the separate position to the contact position.

In the present embodiment, the load torque applied in FIG. 17A is larger than the load torque applied in FIG. 17B. Therefore, the force Ftr applied from (the tooth of) the drive gear 76 to (the tooth of) the driven gear 25*b* when the drive gear 76 rotates in the counterclockwise direction as illustrated in FIG. 17A is larger than the force Ftr applied from (the tooth of) the drive gear 76 to (the tooth of) the driven gear 25*b* when the drive gear 76 rotates in the clockwise direction as illustrated in FIG. 17B.

Since the center of rotation O2 of the driven gear 25*b* is located above the center of rotation O1 of the drive gear 76, rotating the drive gear 76 in the clockwise direction as illustrated in FIG. 17B affects the force Ftr as follows. That is, the inclination of the direction of force Ftr2 applied from (the tooth of) the drive gear 76 to (the tooth of) the driven gear 25*b* with respect to the vertical direction (i.e., −X direction in FIG. 17B) when the drive gear 76 rotates in the clockwise direction in FIG. 17B is larger than the inclination of the direction of the force Ftr2 with respect to the vertical direction when the drive gear 76 rotates in the counterclockwise direction as illustrated in FIG. 17A. Therefore, the ratio of device detaching component force F2 of the force Ftr2 that is applied from (the tooth of) the drive gear 76 to (the tooth of) the driven gear 25*b* increases. However, the load torque to rotate the drive gear 76 in the clockwise direction in FIG. 17B is smaller than the load torque to rotate the drive gear 76 in the counterclockwise direction in FIG. 17A. Therefore, the force Ftr2 applied from (the tooth of) the drive gear 76 to (the tooth of) the driven gear 25*b* in FIG. 17B is smaller than the force Ftr2 in FIG. 17A. Even if the ratio of the device detaching component force F2 (i.e., Y direction in FIG. 17B) of the force Ftr2 applied from (the tooth of) the drive gear 76 to (the tooth of) the driven gear 25*b* increases by a certain amount, the device detaching component force F2 may be smaller than the static friction force of the positioning projection 44*e* and the positioning portion 182*a*. Accordingly, when the motor 72 rotates in the normal direction (in other words, when the cleaning roller 44*d* is moved from the separate position to the contact position), one widthwise end of the fixing device 44 is prevented from moving in the detaching direction of the fixing device 44.

On the other hand, since the center of rotation O2 of the driven gear 25*b* is located above the center of rotation O1 of the drive gear 76, rotating the drive gear 76 in the counterclockwise direction as illustrated in FIG. 17A affects the force Ftr as follows. That is, the inclination of the direction of force Ftr1 applied from (the tooth of) the drive gear 76 to (the tooth of) the driven gear 25*b* with respect to the vertical direction when the drive gear 76 rotates in the counterclockwise direction (i.e., the X direction in FIG. 17A) is smaller than the inclination of the direction of the force Ftr1 with respect to the vertical direction when the drive gear 76 rotates in the clockwise direction in FIG. 17B. Therefore, the ratio of the device detaching component force F1 of the force Ftr1 applied from (the tooth of) the drive gear 76 to (the tooth of) the driven gear 25*b* decreases.

In the configuration illustrated in FIG. 17A, the load torque applied to rotate the drive gear 76 in the counterclockwise is larger than the load torque applied to rotate the drive gear 76 in the clockwise direction in FIG. 17B. Therefore, the force Ftr1 in the configuration illustrated in FIG. 17A is larger than the force Ftr2 in the configuration illustrated in FIG. 17B. However, even if the force Ftr1 that is applied from (the tooth of) the drive gear 76 to (the tooth of) the driven gear 25*b* (in FIG. 17A) is larger than the force Ftr2 that is applied from (the tooth of) the drive gear 76 to (the tooth of) the driven gear 25*b* (in FIG. 17B), the device detaching component force F1 of the force Ftr1 (i.e., the Y direction in FIG. 17A) may be smaller than the static friction force of the positioning projection 44*e* and the positioning portion 182*a*. Accordingly, when the motor 72 and the cam 25 rotate in the reverse direction (in other words, when the cleaning roller 44*d* is moved from the contact position to the separate position), one widthwise end of the fixing device 44 is prevented from moving in the detaching direction of the fixing device 44.

Next, a description is given of a specific example of the gear angle θ between the driven gear 25*b* and the drive gear 76, in which the fixing device 44 would not move in the detaching direction during the rotation of the drive gear 76 in the normal and reverse directions.

When the drive gear 76 rotates in the counterclockwise direction in FIG. 16, the gear angle θ is obtained by the following equation:

$$\theta=\phi+\alpha t-90°.$$

When the drive gear 76 rotates in the clockwise direction in FIG. 16, the gear angle is obtained by the following equation:

$$\theta=90°-\phi-\alpha t.$$

Note that, as described above, the angle φ is an angle between the line of the direction of the force Ftr applied from the drive gear 76 to the driven gear 25*b* and the line of the attaching direction of the fixing device 44. Similarly, the angle at is an angle between the line of the direction of the force Ftr applied from the drive gear 76 to the driven gear 25*b* and the line of the direction of the tangent line at the meshing portion of the drive gear 76 and the driven gear 25*b*. The angle at is nearly equal to the pressure angle.

1. Driving Conditions of Image Forming Apparatus.

Load torque T1 when the cam 25 rotates in the reverse direction (when the cleaning roller 44*d* is moved from the contact position to the separate position, that is, when the drive gear 76 rotates in the counterclockwise direction in FIG. 17A): 0.15 Nm; and Load torque T2 when the cam 25 rotates in the normal direction (when the cleaning roller 44*d* is moved from the separate position to the contact position, that is, when the drive gear 76 rotates in the clockwise direction in FIG. 17B): 0.05 Nm.

2. Drive Gear Conditions.

Reference Pitch Diameter d: 14.772;

Pressure Angle α: 20°; and

Drive Gear 76 and Driven Gear 25*b*: Helical gear having helix angle β of 12°.

3. Unit Conditions.

Weight Mg of Fixing Device: 1.5 kg; and

Coefficient of Static Friction Force μ between Positioning Projection 44*e* and Positioning Portion 182*a*: 0.35 (ABS resin).

The tangential force Ft applied to the meshing portion between the drive gear 76 and the driven gear 25*b* is represented by the following equation;

$$Ft=2000(T/d).$$

Consequently, when the cam 25 rotates in the reverse direction, as illustrated in FIG. 17A, the tangential force Ft' is obtained by the following calculation;

$$Ft1=2000(0.15/14.772)=20.38\text{N} \quad (1).$$

Further, when the cam 25 rotates in the normal direction, as illustrated in FIG. 17B, the tangential force Ft2 is obtained by the following calculation;

$$Ft2=2000(0.05/14.772)=6.79\text{N} \quad (2).$$

The radial force Fr applied to the meshing portion of the drive gear 76 and the driven gear 25*b* is expressed by the following equation;

$$Fr=Ft(\tan\alpha/\cos\beta).$$

Consequently, when the cam 25 rotates in the reverse direction, as illustrated in FIG. 17A, the radial force Fr1 is obtained by the following calculation;

$$Fr1=20.38(\tan 20°/\cos 12°)=7.58N \quad (3)$$

Further, when the cam 25 rotates in the normal direction (as illustrated in FIG. 17B), the radial force Fr2 is obtained by the following calculation;

$$Fr2=6.79(\tan 20°/\cos 12°)=2.53N \quad (4)$$

Here, the angle at between the line of the direction of the force Ftr applied from the drive gear 76 to the driven gear 25*b* and the tangential line of the direction at the meshing portion is obtained by the following calculation;

$$\begin{aligned}\alpha t &= \mathrm{acot}(Ft1/Fr1) \quad (5)\\ &= \mathrm{acot}(20.38/6.79)\\ &= 20.41°\end{aligned}$$

Accordingly, the angle at between the line of the direction of the force Ftr applied from the drive gear 76 to the driven gear 25*b* and the line of the tangential direction at the meshing portion is substantially the same as the pressure angle α=20°.

From the angle at and the tangential force Ft1, the force Ftr1 applied to (the tooth of) the driven gear 25*b* when the cam 25 rotates in the reverse direction, as illustrated in FIG. 17A, is obtained by the following calculation;

$$\begin{aligned}Ftr1 &= Ft1/\mathrm{COS}\alpha t\\ &= 20.38/\mathrm{COS}20.41\\ &= 21.74N.\end{aligned}$$

Further, the force Ftr2 applied to (the tooth of) the driven gear 25*b* when the cam 25 rotates in the normal direction, as illustrated in FIG. 17B, is obtained by the following calculation;

$$\begin{aligned}Ftr2 &= Ft2/\mathrm{COS}\alpha t\\ &= 6.79/\mathrm{COS}20.41\\ &= 7.25N.\end{aligned}$$

The static friction force μ of the positioning projection 44*e* and the positioning portion 182*a* is obtained by the following calculation;

$$F\mu=\mathrm{Mg}\times 9.8\times\mu=1.5\times 9.8\times 0.35=5.18\mathrm{N}.$$

Both the device detaching component force F1 applied when the cam 25 rotates in the reverse direction, as illustrated in FIG. 17A, and the device detaching component force F2 applied when the cam 25 rotates in the normal direction, as illustrated in FIG. 17B, are equal to or smaller than the above-described static friction force μ. (To be more specific, the relations are described as Fμ≥F1 and Fμ≥F2.)

Angle ϕ1 between the line of the direction of the force Ftr1 applied from the drive gear 76 to the driven gear 25*b* and the line of the attaching direction of the fixing device 44 when the cam 25 rotates in the reverse direction (as in FIG. 17A) is expressed by the following equation;

$$\phi 1=a\cos(F1/Ftr1).$$

Angle ϕ2 between the line of the direction of the force Ftr2 applied from the drive gear 76 to the driven gear 25*b* and the line of the attaching direction of the fixing device 44 when the cam 25 rotates in the normal direction (as in FIG. 17B) is expressed by the following equation;

$$\phi 2=a\cos(F2/Ftr2).$$

When the cam 25 rotates in the reverse direction (as in FIG. 17A) and the device detaching component force F1 equals the force Fμ (5.18N), gear angle θ1 is obtained by the following calculation;

$$\begin{aligned}\theta 1 &= \phi 1 + \alpha t - 90°\\ &= \mathrm{acos}(F\mu/Ftr1) + \alpha t - 90°\\ &= \mathrm{acos}(5.18/21.74) + 20.41 - 90°\\ &= 6.64°.\end{aligned}$$

According to this calculation result, when the gear angle θ1 is less than 6.64°, the device detaching component force F1 is beyond the static friction force Fμ (that is, 5.18N). As a result, when the cam 25 rotates in the reverse direction (as illustrated in FIG. 17A, that is, when the cleaning roller 44*d* moves from the contact position to the separate position), one widthwise end of the fixing device 44 moves in the detaching direction of the fixing device 44. On the other hand, when the gear angle θ1 is equal to or greater than 6.64°, the device detaching component force F1 applied when the cam 25 rotates in the reverse direction is equal to or smaller than the static friction force F (that is, 5.18N). Therefore, one widthwise end of the fixing device 44 does not move in the detaching direction of the fixing device 44.

Further, when the cam 25 rotates in the normal direction (as in FIG. 17B) and the device detaching component force F2 equals to Fμ (5.18N), gear angle θ2 is obtained by the following calculation;

$$\begin{aligned}\theta 2 &= 90° - \phi 2 - \alpha t\\ &= \mathrm{acos}(F\mu/Ftr2) + \alpha t - 90°\\ &= 90° - \mathrm{acos}(5.18/7.25) - 20.41\\ &= 25.17°.\end{aligned}$$

According to this calculation result, when the gear angle θ2 is greater than 25.17°, the device detaching component force F2 is beyond the static friction force Fμ (that is, 5.18N). As a result, when the cam 25 rotates in the normal direction (as in FIG. 17B, that is, when the cleaning roller 44*d* moves from the separate position to the contact position), one widthwise end of the fixing device 44 moves in the detaching direction of the fixing device 44. On the other hand, when the gear angle θ2 is equal to or smaller than 25.17°, the device detaching component force F2 applied when the cam 25 rotates in the normal direction is equal to or smaller than the static friction force Fμ (that is, 5.18N).

Therefore, such one widthwise end of the fixing device 44 does not move in the detaching direction of the fixing device 44.

Therefore, when the driving conditions, the drive gear conditions, and the unit conditions are the above-described conditions, the gear angle θ is set to 6.61° or greater and 25.41° or smaller. Here, the gear angle θ is an angle between the line Y that is parallel to the attaching direction of the fixing device 44 and the line segment L1 connecting the center of rotation O1 of the drive gear 76 and the center of rotation O2 of the driven gear 25*b*. By so doing, when the cam 25 rotates in the normal and reverse directions, one widthwise end of the fixing device 44 is prevented from moving in the detaching direction of the fixing device 44.

Further, as the gear angle θ is set to 20.41° or greater under the above-described conditions, the device detaching component force F1 is generated in the force Ftr1 applied from (the tooth of) the drive gear 76 to (the tooth of) the driven gear 25*b* when the load torque in the rotational direction is large as illustrated in FIG. 17A. Accordingly, when the cleaning roller 44*d* having a greater load torque in the rotational direction is moved from the contact position to the separate position, contact force to cause the positioning projection 44*e* to contact the positioning portion 182 is exerted, and therefore the fixing device 44 is positioned properly.

Note that the above-described configuration is an example applied to the fixing device 44 but this disclosure is not limited to this configuration. For example, this disclosure may be applied to a configuration in which a motor rotates in the normal and reverse directions to position a unit to the housing of an image forming apparatus that rotates a drive member in the normal and reverse directions. For example, a color image forming apparatus including an intermediate transfer unit causes a color primary transfer roller to contact to or separate from the intermediate transfer unit depending on monochrome image formation and color image formation. This disclosure may be applied to the color image forming apparatus including a contact and separation mechanism provided with a motor that is rotatable in the forward and reverse directions. As the motor rotates in the forward and reverse directions, the color image forming apparatus causes the primary transfer roller to contact with and separate from the intermediate transfer unit.

The configurations according to the above-descried embodiments are not limited thereto. This disclosure can achieve the following aspects effectively.

Aspect 1

An image forming apparatus (for example, the image forming apparatus 1000) in Aspect 1 of the present disclosure includes a housing (for example, the housing 50), a unit (for example, the fixing device 44) including a drive member (for example, the cam 25) and positioned to the housing, and a drive device (for example, the drive device 70) configured to rotate the drive member in normal and reverse directions. The drive device includes a housing-side gear (for example, the drive gear 76) mounted on the housing, and a unit-side gear (for example, the driven gear 25*b*) mounted on the unit. The unit-side gear is configured to mesh with the housing-side gear. When transmitting a driving force to the drive member, a component force (for example, the device detaching component force F) in a direction to detach the unit from the housing is exerted in force (for example, the force Ftr) applied from the housing-side gear to the unit-side gear and is smaller than static friction force (for example, the static friction force Fμ between the positioning projection 44*e* and the positioning portion 182*a*) between the unit and the housing.

When the driving force is transmitted to the drive member such as the cam 25, the force is exerted from the housing-side gear such as the drive gear 76 to the unit-side gear such as the driven gear 25*b*, in the direction substantially according to a pressure angle. The unit such as the fixing device 44 is pressed by the force from the housing-side gear to the unit-side gear. Depending on the positioning direction in which the unit is positioned to the housing (for example, the direction to attach a positioning target portion such as the positioning projection 44*e* to a positioning portion such as the positioning portion 182*a* of the housing 50) and the relative positions of the unit-side gear and the housing-side gear, the component force in the detaching direction of the unit (such as the device detaching component force F) is exerted in the force from the housing-side gear to the unit-side gear. The unit is not positioned in the detaching direction and has a certain amount of backlash. If there is a component (component force) in the detaching direction (in the direction in which the unit is detached from the housing) in the force applied from the housing-side gear to the unit-side gear, the unit may be moved due to the component.

Therefore, in Aspect 1 of the present disclosure, the component (the component force) in the detaching direction of the unit exerted in the force applied from the housing-side gear to the unit-side gear is smaller than the static friction force applied to the housing of the unit. By so doing, the unit is prevented from being moved in the detaching direction of the unit due to the component in the detaching direction of the unit exerted in the force applied from the housing-side gear to the unit-side gear.

Aspect 2

In Aspect 1 of the present disclosure, the unit-side gear (for example, the driven gear 25*b*) is disposed upstream from the housing-side gear (for example, the drive gear 76) in a positioning direction (for example, the −Y direction in FIG. 3) of the unit (for example, the fixing device 44) to be positioned to the housing (for example, the housing 50). At the same time, the unit-side gear is disposed downstream from a line (for example, the line L2) that passes a center of rotation of the housing-side gear (for example, the center of rotation O1) and that is parallel to the positioning direction of the unit, in a rotational direction of the housing-side gear having a greater load torque (hereinafter, a first rotational direction). A load torque of the housing-side gear in the rotational direction applied to the housing-side gear when the drive member (for example, the cam 25) rotates in a normal direction is different from a load torque of the housing-side gear in the rotational direction applied to the housing-side gear when the drive member rotates in a reverse direction. In addition, in the present embodiment, the first rotational direction indicates a counterclockwise direction (CCW) of the housing-side gear such as the drive gear 76 in FIG. 16. In other words, the first rotational direction indicates a rotational direction of the housing-side gear having a greater load torque, between the rotational direction of the housing-side gear when the drive member rotates in the normal direction and a rotational direction of the housing-side gear when the drive member rotates in the reverse direction.

According to this configuration, as described in the embodiments above, since the unit-side gear such as the driven gear 25*b* is disposed upstream from the housing-side gear such as the drive gear 76 in the positioning direction, the housing-side gear and the unit-side gear are meshed with each other when the unit is positioned to the housing of the image forming apparatus. However, in the configuration in which the unit-side gear is disposed upstream from the housing-side gear in the positioning direction, when the housing-side gear rotates in the normal and reverse directions, the force (the force Ftr) applied from the housing-side gear to the unit-side gear includes the component force in the detaching direction of the unit (the device detaching component force F). Then, when the housing-side gear has a greater load torque in the rotational direction between rotation of the drive member in the normal direction and rotation of the drive member in the reverse direction, the component force in the detaching direction of the unit is greater than the static friction force of the positioning member (for example, the positioning projection 44*e*) and the positioning target member (for example, the positioning portion 182*a*), and the unit moves in the detaching direction of the unit.

In order to address this inconvenience, in Aspect 2, as illustrated in FIG. 16, a center of rotation of the unit-side gear (for example, the center of rotation O2), which is on a line (for example, the line segment L1) from a center of rotation of the housing-side gear (for example, the center of rotation O1), is disposed downstream from another line (for example, the line L2) parallel to the positioning direction of the unit, in a rotational direction of the housing-side gear having a greater load torque (the counterclockwise direction CCW) between rotation of the drive member in the normal direction and rotation of the drive member in the reverse direction. Consequently, as described above with reference to FIG. 17, when the housing-side gear rotates in the counterclockwise direction (CCW) in which the load torque of the housing-side gear in the rotational direction is large, the ratio of the component force in the detaching direction of the unit in which the positioning of the unit is detached from the housing (for example, the device detaching component force F1) decreases with respect to the force applied from the housing-side gear to the unit-side gear (for example, the force Ftr1). Accordingly, when the housing-side gear rotates in the counterclockwise direction (CCW) in which the load torque of the housing-side gear in the rotational direction is large, the component force in the detaching direction of the unit (the device detaching component force F1) is prevented from being greater than the static friction force.

On the other hand, when the housing-side gear rotates in a clockwise direction (CW) in which the load torque of the housing-side gear in the rotational direction is small, the ratio of the component force in the detaching direction of the unit in which the positioning of the unit is detached from the housing (for example, the device detaching component force F2) increases with respect to the force applied from the housing-side gear to the unit-side gear (for example, the force Ftr2). However, since the load torque of the housing-side gear in the rotational direction is relatively small, the force (for example, the force Ftr2) applied from the tooth of the housing-side gear to the tooth of the unit-side gear is also relatively small. Therefore, even if the ratio of the component force (for example, the device detaching component force F2) in the detaching direction of the unit increases, the device detaching component force F2 is not greater than the static friction force.

Accordingly, the unit is effectively prevented from moving in the direction to detach from the positioning to the housing when the housing-side gear rotates in the normal and reverse directions.

Aspect 3

In Aspect 2 of the present disclosure, the unit-side gear is disposed at a position at which a force applied from the housing-side gear to the unit-side gear includes a component force in the positioning direction of the unit in one of the rotation of the drive member in the normal direction and the rotation of the drive member in the reverse direction. The housing-side gear has a greater load torque in a rotational direction in the one than the other of the rotation of the drive member in the normal direction and the rotation of the drive member in the reverse direction.

According to this aspect of the present disclosure, as described in the embodiments above, since the component in the positioning direction of the unit is exerted when the housing-side gear has the greater load torque in the rotational direction between the rotation of the drive member in the normal direction and the rotation of the drive member in the reverse direction, the unit is continuously positioned to the housing.

Aspect 4

In any one of Aspects 1 to 3 of the present disclosure, the image forming apparatus (for example, the image forming apparatus 1000) further including a sheet conveying member (for example, the pressure roller 44*b*) configured to convey a sheet (the recording sheet S) to the unit (for example, the fixing device 44). The drive member (for example, the cam 25) rotates while the sheet conveying member is conveying the sheet.

According to this aspect of the present disclosure, as described in the embodiments above, the unit such as the fixing device 44 is prevented from moving when the drive member such as the cam 25 during sheet conveyance in which the sheet is being conveyed to the unit, for example, during the fixing operation. Accordingly, occurrence of creases in the sheet is prevented.

Aspect 5

In any one of Aspects 1 to 4 of the present disclosure, the unit is a fixing unit (for example, the fixing device 44) configured to fix an image formed on a sheet (for example, the recording sheet S) to the sheet.

According to this aspect of the present disclosure, as described in the embodiments above, the fixing unit such as the fixing device is positioned preferably with respect to the housing such as the housing 50.

Aspect 6

In any one of Aspects 1 to 5 of the present disclosure, the unit (for example, the fixing device 44) includes a contact-separation member (for example, the cleaning roller 44*d*) and a contact-separation target member (for example, the pressure roller 44*b*) disposed facing the contact-separation member. The contact-separation member is configured to contact and separate with respect to the contact-separation target member as the drive member (for example, the cam 25) rotates in the normal direction and the reverse direction.

According to this aspect of the present disclosure, as described in the embodiments above, the unit such as the fixing device 44 is prevented from moving when the contact-separation member such as the cleaning roller 44*d* contacts to or separates from the contact-separation target member such as the pressure roller 44*b*.

Aspect 7

In Aspect 6 of the present disclosure, the contact-separation member is a cleaning roller (for example, the cleaning roller 44*d*).

According to this aspect of the present disclosure, as described in the embodiments above, the cleaning roller (44*d*) is separated from the contact-separation target member (for example, the pressure roller 44*b*) before the cleaning roller (44*d*) is heated by the contact-separation target member to reach a high temperature. Therefore, it is prevented that toner that is removed from the contact-separation target member and attached to the cleaning roller (44*d*) melt and attach to the contact-separation target member again.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

What is claimed is:

1. An image forming apparatus, comprising:

a housing;

a unit including a drive member and being positioned to the housing; and a drive device configured to rotate the drive member in a normal direction and a reverse direction, the drive device including a housing-side gear mounted on the housing; and a unit-side gear mounted on the unit, the unit-side gear being configured to mesh with the housing-side gear, and the drive device transmitting a driving force to the drive member, the driving force causing a force from the housing-side gear to the unit-side gear, the force including a component force in a direction to detach the unit from the housing, the component force being smaller than a static friction force between the unit and the housing.

2. The image forming apparatus according to claim 1, wherein the unit-side gear is disposed upstream from the housing-side gear in a positioning direction of the unit to be positioned to the housing, and wherein a center of rotation of the unit-side gear is disposed downstream from a line that passes a center of rotation of the housing-side gear and that is parallel to the positioning direction of the unit, in a rotational direction of the housing-side gear having a greater load torque between a rotational direction of the housing-side gear in rotation of the drive member in the normal direction and a rotational direction of the housing-side gear in rotation of the drive member in the reverse direction.

3. The image forming apparatus according to claim 2, wherein the unit-side gear is disposed at a position at which a force applied from the housing-side gear to the unit-side gear includes a component force in the positioning direction of the unit in one of the rotation of the drive member in the normal direction and the rotation of the drive member in the reverse direction, and wherein the housing-side gear has a greater load torque in a rotational direction in the one than the other of the rotation of the drive member in the normal direction and the rotation of the drive member in the reverse direction.

4. The image forming apparatus according to claim 1, further comprising a sheet conveying member configured to convey a sheet to the unit, wherein the drive member is configured to rotate while the sheet conveying member is conveying the sheet.

5. The image forming apparatus according to claim 1, wherein the unit is a fixing unit configured to fix an image formed on a sheet to the sheet.

6. The image forming apparatus according to claim 1, wherein the unit further includes:

a contact-separation member; and a contact-separation target member disposed facing the contact-separation member, and wherein the contact-separation member is configured to contact and separate with respect to the contact-separation target member as the drive member rotates in the normal direction and the reverse direction.

7. The image forming apparatus according to claim 6, wherein the contact-separation member is a cleaning roller.

* * * * *